US006693603B1

(12) United States Patent
Smith et al.

(10) Patent No.: US 6,693,603 B1
(45) **Date of Patent: *Feb. 17, 2004**

(54) COMMUNICATIONS ANTENNA STRUCTURE

(75) Inventors: Martin Stevens Smith, Chelmsford (GB); Anton Keith Bush, Cambridge (GB)

(73) Assignee: Nortel Networks Limited, St. Laurent (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/222,555

(22) Filed: Dec. 29, 1998

(51) Int. Cl.[7] ..... H01Q 1/36; H01Q 1/48

(52) U.S. Cl. ..... 343/846; 343/700 MS; 343/830

(58) Field of Search ..... 343/797, 826, 343/825, 828–830, 700 MS, 702, 846, 872; H01Q 1/38, 1/36, 1/48

(56) References Cited

U.S. PATENT DOCUMENTS

| | | | | | |
|---|---|---|---|---|---|
| 5,138,328 | A | * | 8/1992 | Zibrik et al. | 343/702 |
| 5,365,246 | A | * | 11/1994 | Rasinger et al. | 343/702 |
| 5,757,333 | A | | 5/1998 | Kitchener | 343/826 |
| 5,771,025 | A | * | 6/1998 | Reece et al. | 343/846 |
| 5,977,917 | A | * | 11/1999 | Hirose | 343/702 |
| 5,986,618 | A | * | 11/1999 | Aakula et al. | 343/702 |
| 6,140,975 | A | * | 10/2000 | Cohen | 343/846 |

* cited by examiner

*Primary Examiner*—Michael C. Wimer
(74) *Attorney, Agent, or Firm*—Barnes & Thornburg

(57) ABSTRACT

The present invention relates to a communications antenna structure. The communications antenna structure comprises first and second antennas each having an axis about which a mode of electrical field vector polarisation can be generated. In a first orientation, with an axis associated with the structure vertical, the first antenna operates in a horizontal mode of electrical field vector polarisation and the second antenna operates in a vertical mode of electrical field vector polarisation; and, in a second orientation, with said structure axis horizontal, the first antenna operates in a vertical mode of electrical field vector polarisation and the second antenna operates in a horizontal mode of electrical field vector polarisation.

13 Claims, 34 Drawing Sheets

Overall Dimensions of TDMA Picocell

All measurements in mm
Brack ted numbers refer to 800MHz Antenna

1 Wall Azimuth Angles z axis=0
2 Ceiling Azimuth Angles x axis=0

Antenna A Ceiling Azimuth@1900MHz

Antenna B Ceiling Azimuth@1900MHz

Ceiling mount Combined antennas (in phase)@1900MHz

Antenna A Wall Azimuth@1900MHz

Antenna B Wall Azimuth@1900MHz

Wall Azimuth combined antennas (in phase) @1900MHz

Ceiling Azimuth Antenna A @850MHz

Ceiling Azimuth Antenna B @850MHz

Ceiling mount Combined antennas (in phase) @850MHz

Wall Azimuth Antenna A @850MHz

Wall Combined Antennas @850MHz

Antenna A Wall Mounted Azimuth Pattern at 1.92GHz

Antenna B Wall Mounted Azimuth Pattern at 1.92GHz

Antenna A Ceiling Mounted Azimuth Pattern at 1.92GHz

Antenna B Ceiling Mounted Azimuth Pattern at 1.92GHz

Wall Mount Antenna A Azimuth @850MHz

Ceiling mount Antenna A Azimuth @850MHz

Ceiling mount Azimuth combined Antennas @850MHz

COMMUNICATIONS ANTENNA STRUCTURE

FIELD OF THE INVENTION

The present invention relates to a communications antenna a structure and cellular base stations and in particular, but not necessarily restricted thereto, relates to micro-cellular and pico-cellular basestations and antennas therefor.

BACKGROUND TO THE INVENTION

In addition to public cellular radio systems, cellular communications systems are being developed for use in a local area, e.g. in a factory or an office building to provide a wireless communications service. The base station employs antennas to transmit and receive radio frequency signals over, for example an outdoor micro-cell with a 200 m radius, or an indoor pico-cell with a 30–50 m radius. In such a system, communication takes place over a radio interface between user handsets and one or more base stations. Each base station is provided with an antenna structure whereby to communicate with user handsets in its particular service area. Such micro-cellular and pico-cellular basestations may also be employed in a public cellular system to cover "dead" spots such as those which may be generated within a shopping mall or similar, or otherwise supplement the coverage provided by a wide area coverage cellular basestation.

Typically the base station is in a "cluttered" environment such that energy received from a given handset arrives at a basestation via many paths. The path can be direct (line of sight) or indirect due to reflections and diffractions from local scatterers (buildings, furniture, ground, ceiling, etc.). The basestation is said to be in a multipath environment. The incoming multipath field vectors can add constructively or destructively, and this depends upon the relative amplitude and phase of the different components. Since the phase of each component will vary independently as a handset is moved, the received signal at the basestation varies considerably in magnitude, and this effect is known as multipath fading.

One way of overcoming multipath fading is to provide two channels for the received signal such that they are independent of each other i.e. the signals are uncorrelated—when one channel is in a fade, the other channel is typically unfaded. Consequently, the base station selects the channel with the strongest signal to overcome fading whereby to provide a reliable communications link. This is a form of diversity reception. One way of providing diversity reception is to use two antenna elements, which is known as antenna diversity. When the basestation switches between the elements, instead of combining the elements, then this is known as switched antenna diversity. Accordingly, it is a requirement of the antenna structure is to provide polarisation and/or space diversity and also to provide a substantially uniform beam pattern so that there are no 'dead' spots in the area served by the base station and so that the orientation of a user handset has substantially no effect on the call quality.

A further requirement of a base station antenna structure is to provide a structure which is suitable for both wall and ceiling mount and to provide a uniform coverage with reasonable gain (~0 dBi) sufficient to service a significantly large area. It will be appreciated that, as base stations are relatively costly to manufacture and maintain, there is a significant cost advantage in providing effective service areas so as to minimise the number of base stations required for a particular installation. It has been found difficult to provide this uniformity of coverage in a compact antenna structure.

For modern telecommunications applications, apart from the electrical performance of the antenna other factors need to be taken into account, such as size, weight, cost and ease of construction of the antenna. With the increasing deployment of cellular radio, an increasing number of base stations which communicate with mobile handsets are required. Such antennas are required to be both inexpensive and easy to produce. A further requirement is that the antenna structures be of light weight yet of sufficient strength to be placed on the top of support poles, rooftops and similar places and maintain long term performance over environmental extremes.

The conventional approach to the problem of achieving diversity is the provision of a simple dipole structure which has been found adequate for many applications. However, at the frequencies involved (825–895 MHz and 1850–1990 MHz) the dimensions of the conventional dipole may be inconveniently large. Urban planning authorities are now demanding that base stations that are exposed to public view be enclosed in a relatively unobtrusive plastics housing which is generally too small to accommodate both a conventional dipole and the electronic equipment required for operation of the base station. In close proximity the dipole will interact with the base unit and create a non-uniform coverage pattern. A number of small antenna structures have been described, but these do not provide the desired combination of both coverage and diversity for successful employment as base station antenna.

GB-B-2291271 and U.S. Pat. No. 5,757,333 to Northem Telecom Ltd. provide a communications antenna structure, e.g. for a cellular radio base station which comprises first and second bent folded monopole planar antenna elements mounted on a ground plane and disposed generally perpendicular thereto. The antenna elements are mutually spaced from each other and are disposed with their respective planes at an angle to each other whereby to provide both polarisation diversity and space diversity of the antenna structure.

OBJECT OF THE INVENTION

The present invention seeks to provide an improved cellular radio base station. The present invention further seeks to provide a cellular radio base station operable in horizontal and vertical modes of polarisation in first and second mutually perpendicular orientations. The present invention also seeks to provide substantially orthogonal polarisation over several full plane cuts and, a substantially null free coverage in the transmit combined pattern provide a method of operating

STATEMENT OF THE INVENTION

In accordance with a first aspect of the invention there is provided a communications antenna structure comprising:

a body having an axis with a first surface parallel to said axis and a second surface orthogonal to said axis;

wherein the first and second antennas each have an axis about which a mode of electrical field vector polarisation can be generated and wherein the first and second antennas are attached to the first and second surfaces respectively which antennas are positioned on the body whereby the axes of polarisation are orthogonal with respect to each other such that:

in a first orientation, with said body axis vertical, the first antenna operates in a horizontal mode of electrical field vector polarisation and the second antenna operates in a vertical mode of electrical field vector polarisation; and, in a second orientation, with said body axis horizontal, the first antenna operates in a vertical mode of electrical field vector polarisation and the second antenna operates in a horizontal mode of electrical field vector polarisation.

Preferably, the antennas are planar inverted F antennas (PIFA). The first and second planar surfaces are preferably parallel to the planar portions of the first and second PIFAs. The first and second surfaces can be planar.

Conveniently, the body is a generally rectangular box. Conveniently the body encloses the electrical control circuitry associated with the receiver and transmitters for the antennas and the outside surface has heat sink fins to assist in the maintenance of a suitable operating temperature for the electronics.

In accordance with another aspect of the invention, there is provided a communications antenna structure, comprising:

an electrical control circuitry;

a first and a second planar inverted F antennas; and, an earthed shielding structure having an axis, which is arranged to enclose said electrical control circuitry;

wherein the first and second antennas are positioned such that:

in a first orientation, vertical relative to said axis, the first antenna operates in a horizontal mode of electrical field vector polarisation and the second antenna operates in a vertical mode of electrical field vector polarisation; and, in a second orientation, horizontal relative to said axis, the first antenna operates in a vertical mode of electrical field vector polarisation and the second antenna operates in a horizontal mode of electrical field vector polarisation.

In accordance with another aspect of the invention, there is provided a communications antenna structure, comprising:

first and second planar inverted F antennas; and, a structure having an axis;

wherein the first and second antennas each have an axis about which a mode of electrical field vector polarisation can be generated and which axes of polarisation are orthogonal with respect to each other such that:

in a first orientation, vertical relative to said axis, the first antenna operates in a horizontal mode of electrical field vector polarisation and the second antenna operates in a vertical mode of electrical field vector polarisation; and, in a second orientation, horizontal relative to said axis, the first antenna operates in a vertical mode of electrical field vector polarisation and the second antenna operates in a horizontal mode of electrical field vector polarisation.

In accordance with another aspect of the invention, there is provided a radio communications base station arrangement, comprising:

first and second linearly polarised antennas; and, a structure having an axis;

wherein the first and second antennas each have an axis about which a mode of electrical field vector polarisation can be generated and which antennas are positioned whereby the axes of polarisation are orthogonal with respect to each other such that:

in a first orientation, upright relative to said axis, the first antenna operates in a horizontal mode of electrical field vector polarisation and the second antenna operates in a vertical mode of electrical field vector polarisation; and, in a second orientation, horizontal relative to said axis, the first antenna operates in a vertical mode of electrical field vector polarisation and the second antenna operates in a horizontal mode of electrical field vector polarisation.

Preferably, the antennas are planar inverted F antennas. The structure to which the antennas are mounted comprises a body with a first surface parallel to said axis and a second surface orthogonal to said axis and wherein the first and second antennas are attached to the first and second surfaces respectively. Conveniently, the body is generally cuboid. Conveniently the body encloses the electrical control circuitry associated with the receiver and transmitters for the antennas and the outside surface has heat sink fins to assist in the maintenance of a suitable operating temperature for the electronics.

In order to reduce costs it is preferred to have a common physical dimensions to both 1900 MHz and 800 MHz basestations, with the mechanics designed to allow attachment of either an 800 MHz or 1900 MHz antenna.

In accordance with a still further aspect of the invention, there is provided a method of operating a communications antenna structure, comprising: a body having an axis with a first planar surface parallel to said axis and a second planar surface orthogonal to said axis; wherein the first and second antennas each have an axis about which a mode of electrical field vector polarisation can be generated and wherein the first and second antennas are attached to the first and second surfaces respectively which antennas are positioned on the body whereby the axes of polarisation are orthogonal with respect to each other, the method comprising the steps of:

in a first orientation, with said body axis parallel relative to the vertical, feeding rf signals to the first antenna whereby the antenna operates in a horizontal mode of electrical field vector polarisation and feeding rf signals to the second antenna whereby the antenna operates in a vertical mode of electrical field vector polarisation; and, in a second orientation, with said body axis parallel relative to the horizontal, feeding rf signals to the first antenna whereby the antenna operates in a vertical mode of electrical field vector polarisation and feeding rf signals to the second antenna whereby the antenna operates in, a horizontal mode of electrical field vector polarisation.

In accordance with a still further aspect of the invention, there is provided a method of operating a communications antenna structure, comprising: first and second planar inverted F antennas; and, a structure having an axis; wherein the first and second antennas each have an axis about which a mode of electrical field vector polarisation can be generated and which antennas are positioned whereby the axes of polarisation are orthogonal with respect to each other, the method comprising the steps of:

in a first orientation of the base, said axis being vertical, feeding rf signals to the first antenna whereby the antenna operates in a horizontal mode of electrical field vector polarisation and feeding rf signals to the second antenna whereby the antenna operates in a vertical mode of electrical field vector polarisation; and, in a second orientation of the base, said axis being horizontal, feeding rf signals to the first antenna whereby the antenna operates in a vertical mode of electrical field vector polarisation and feeding rf signals to the second antenna whereby the antenna operates in a horizontal mode of electrical field vector polarisation.

In accordance with a still further aspect of the invention, there is provided a method of operating a radio communications base station arrangement, comprising: first and second linearly polarised antennas; and, a structure having an axis; wherein the first and second antennas each have an axis about which a mode of electrical field vector polarisation can be generated and which antennas are positioned whereby the axes of polarisation are orthogonal with respect to each other, the method comprising the steps of:

in a first orientation of the base, said axis being vertical, feeding rf signals to the first antenna whereby the antenna operates in a horizontal mode of electrical field vector polarisation and feeding rf signals to the second antenna whereby the antenna operates in a vertical mode of electrical field vector polarisation; and, in a second orientation of the base, said axis being horizontal, feeding rf signals to the first antenna whereby the antenna operates in a vertical mode of electrical field vector polarisation and feeding rf signals to the second antenna whereby the antenna operates in a horizontal mode of electrical field vector polarisation.

In a yet still further aspect of the invention there is provided a cellular communications network incorporating any of such communications antenna structures.

BRIEF DESCRIPTION OF THE FIGURES

In order that the present invention can be more fully understood and to show how the same may be carried into effect, reference shall now be made, by way of example only, to the Figures as shown in the accompanying drawing sheets wherein.

DETAILED DESCRIPTION OF THE PREFERRED EMBODIMENTS

There will now be described, by way of example, the best mode contemplated by the inventors for carrying out the invention under multipath and single path conditions. In the following description, numerous specific details are set out in order to provide a complete understanding of the present invention. It will be apparent, however, to those skilled in the art, that the present invention may be put into practice with variations of the specific.

Figure 1:
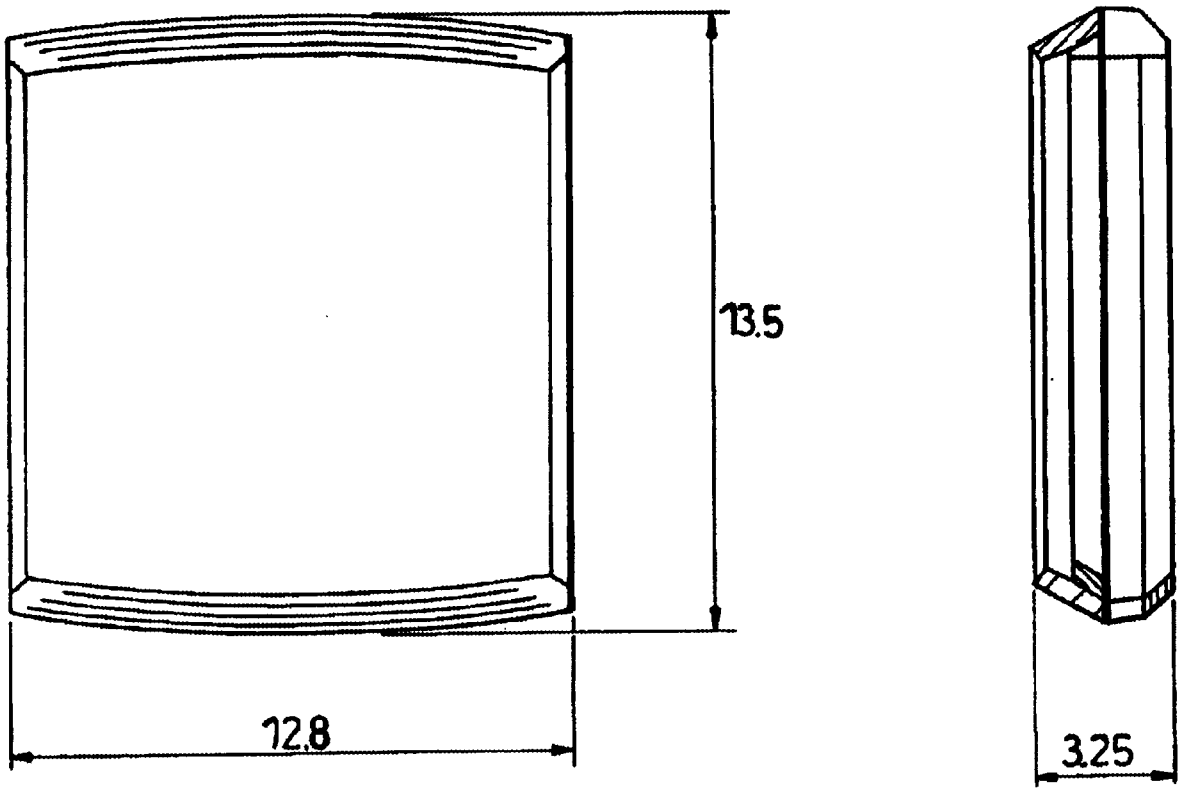
FIG. 1 shows an example of a pico-cell basestation.
Figure 2:
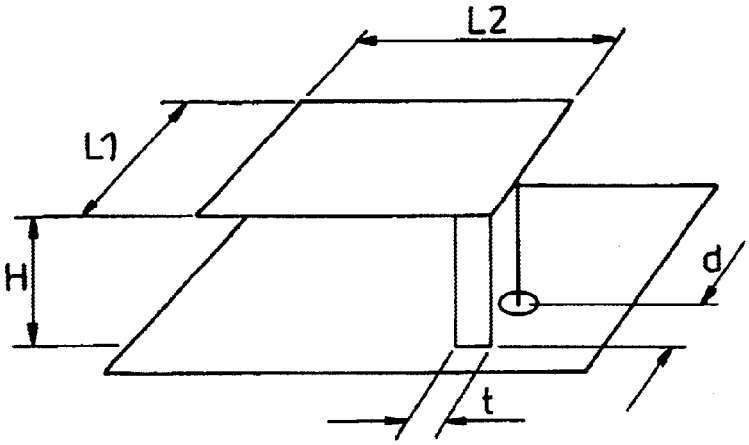
FIG. 2 shows a generic PIFA element.
Figure 3:
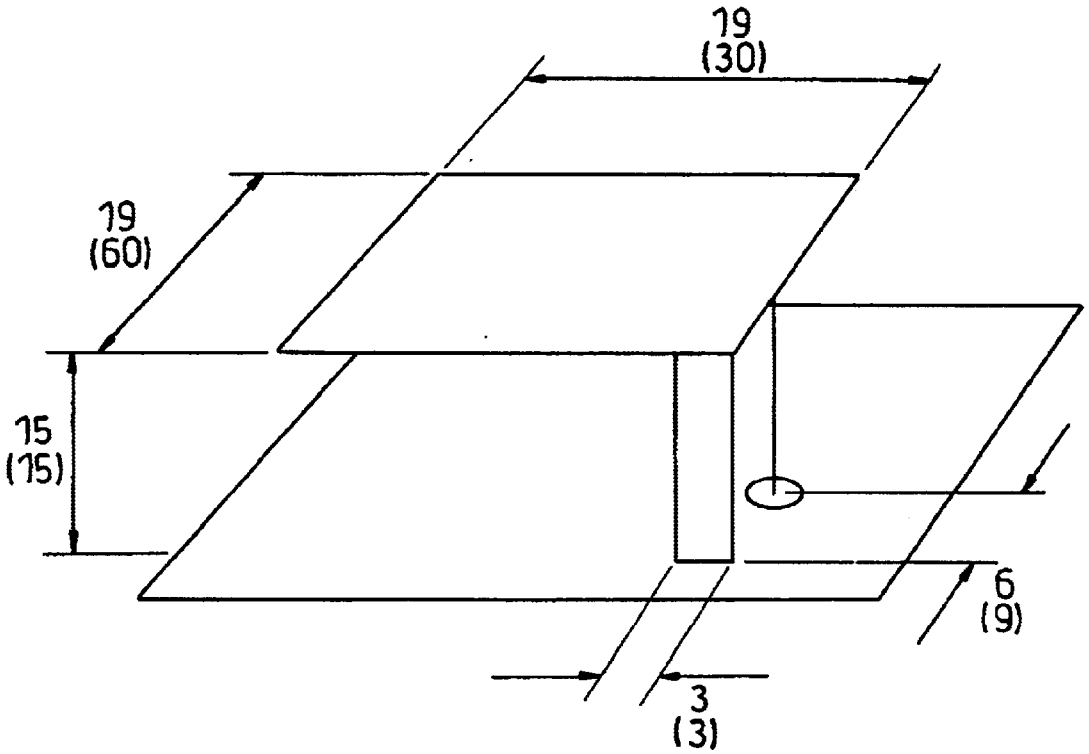
FIG. 3 shows a dimensioned test PIFA.

FIG. 1 shows a pico-/micro-cellular basestation. The design must be as unobtrusive as possible and an overall height of 15 mm was made available in the design iterations for the antenna space between the plastics and the basestation shielding can. Two areas in the heat sink structure are clear of heat sink fins to enable placement of the antennas. Due to the limited height available for the antennas it is not possible to mount a simple element such as a monopole on the basestation at the frequencies of interest (850 MHz and 1900 MHz, being commonly available cellular frequencies). A PIFA (Planar Inverted F Antenna) is conveniently employed, the structure provides a suitably broad bandwidth. A generic element of this type is shown in FIG. 2. Other types of antenna are suitable.

An antenna arrangement for a pico-/micro-cellular basestation preferably provides an option to transmit on two separate antennas without the use of an external hybrid, or any mechanical or electrical switching. This will require at least two antennas on the basestation transmit link. Transmitting on two antennas introduces problems related to the omnidirectionality of the radiation patterns. The reason for this is that the energy radiated from each of the antennas will interact to produce a complex pattern. The two antennas form an array, with the complexity of the pattern structure (number of nulls) being a strong function of the physical location of the antenna elements.

There are a number of ways to reduce this interaction. One method is careful design of radiation pattern so that the two antennas radiate into separate hemispheres. This approach is not suitable for the pico-cell basestation since the receive diversity performance would be greatly affected (there would be no diversity with true ½ space coverage and no angular spread in the received signal). An alternative solution is the use of orthogonal polarisations for the two antenna elements. Since the two polarisations will not interact it is possible to have both elements transmitting simultaneously without adversely affecting transmit omnidirectionality. Due to the omnidirectional patterns of the individual antennas, good receive diversity performance is also achieved with both spatial and polarisation diversity. In order to justify a mixed polarisation in the transmitted signal it is necessary to consider the environment in which the basestation will be operated. In a typical pico-cellular environment there will be a high degree of polarisation mixing.

It is also preferable that diversity is provided for receiving signals. A measure of antenna performance in a typical pico-cellular environment is the power sum of the antenna gains in two orthogonal polarisations. On the transmit link the polarisation mixing in the environment will be random for either a single antenna or for two orthogonally polarised antennas. It is therefore irrelevant whether the power is transmitted with a linear or mixed polarisation. Use of two co-polarised antennas would mean that energy would not be launched in directions where radiation pattern nulls occurred. In this case the basestation performance would be severely affected, because coverage in these directions would be poor. The chosen antenna strategy for the basestation is therefore to use two orthogonally polarised antennas with omnidirectional performance in the azimuth plane for both wall and ceiling mounted configurations. The antennas are combined on the downlink, and used separately as a diversity pair on the uplink.

It has been determined that a single pair of antenna locations will provide two reasonably omnidirectional, orthogonal antenna patterns at both 1900 MHz and 800 MHz. These positions provide acceptable performance in both the ceiling and wall mount configurations. Nevertheless, the physical size of the basestation causes serious problems when trying to create an omnidirectional pattern for an antenna mounted upon it. One solution has been to mount an antenna (antenna A) near to the corner of the basestation. In this way currents flow along the sides of the box thus improving the omnidirectionality of the radiation pattern.

Figure 4A:
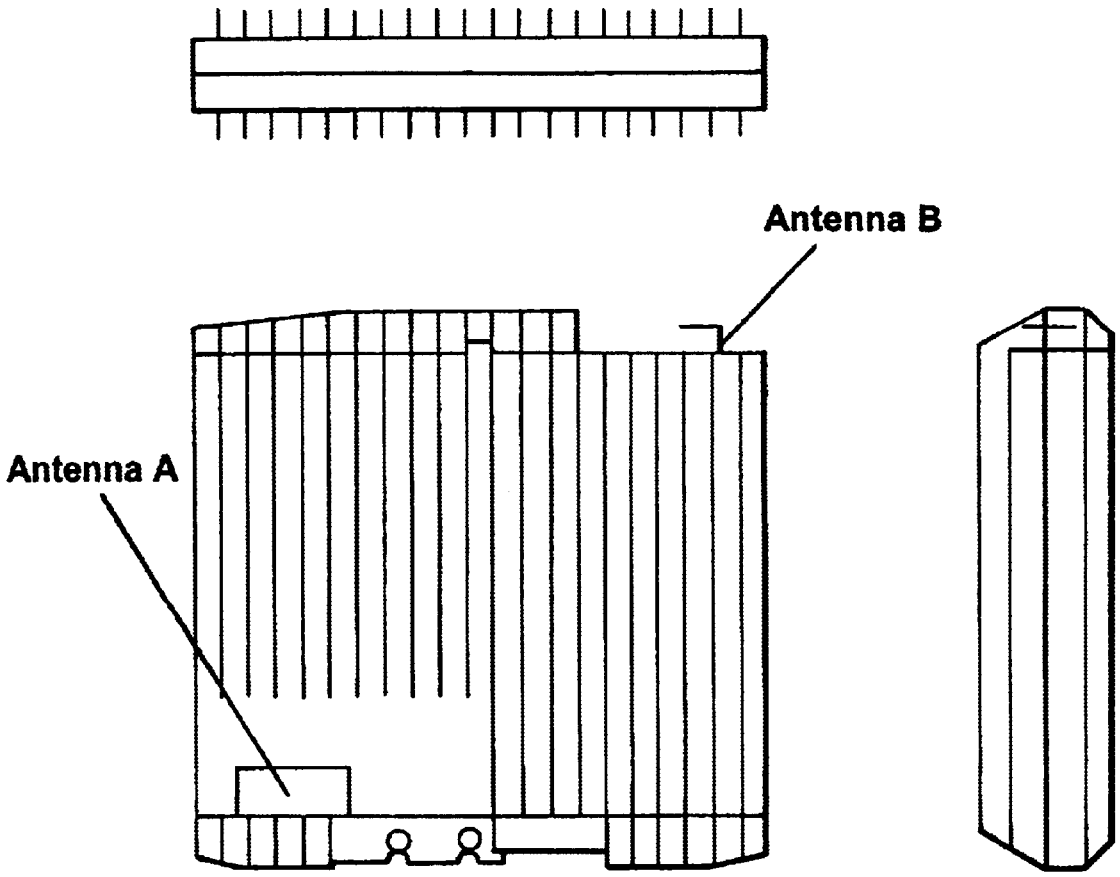
FIG. 4A a pico-/micro-cell structure in accordance with the invention with cover removed.
Figure 4B:
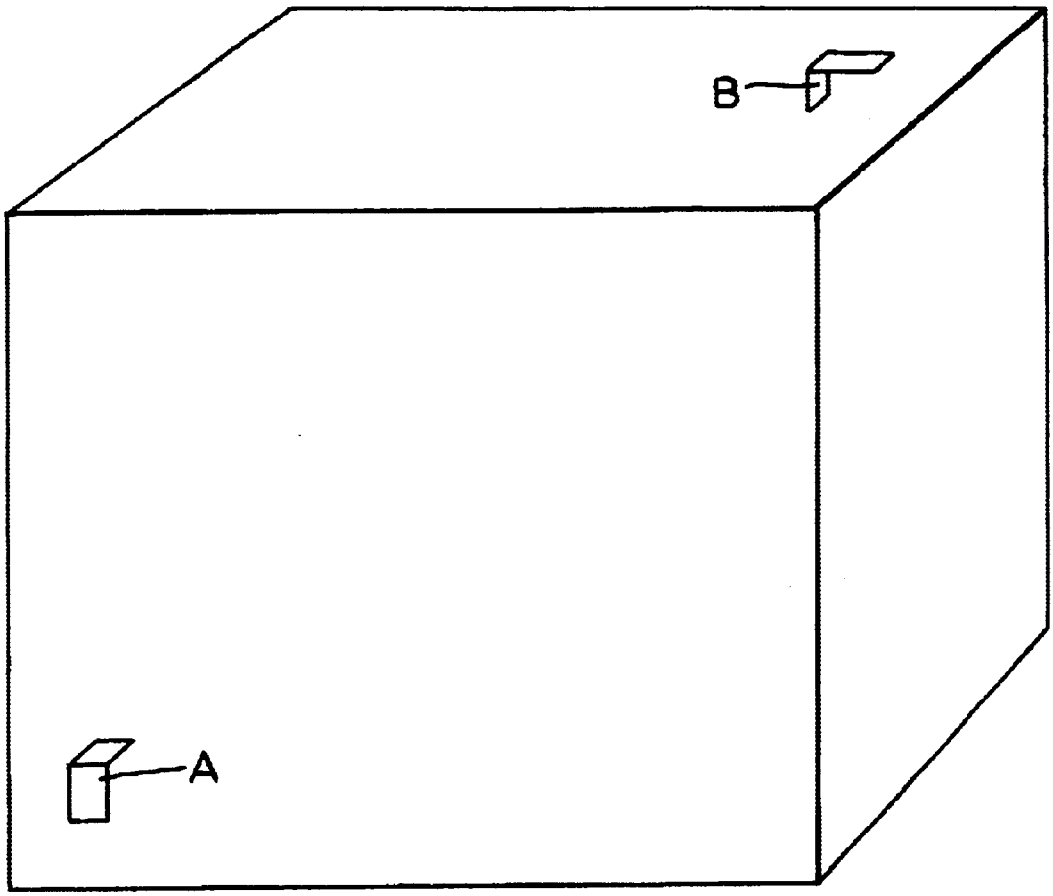
FIG. 4B shows the location of the antennas shown in FIG. 4A.

Placement of the other antenna (Antenna B) must provide a radiation pattern which is orthogonally polarised to that of the first. In order to achieve this the antenna has been placed on the "side" of the basestation. In the ceiling mount configuration it makes negligible difference to pattern omnidirectionality or orthogonality which side the antenna is placed. In the wall mount configuration there is a preferred side. In FIG. 4B, the selected positions for these antennas are optimal in the azimuth plane for both configurations.

In the wall mount configuration Antenna A will be predominantly horizontally polarised due to the orientation of the radiating element. It is therefore desirable to mount Antenna B on the top side of the basestation to provide a predominantly vertically polarised antenna. There will be horizontal components due to currents induced on the basestation shielding can. These currents would be minimised by central placement (in terms of basestation width) along this side. In order to optimise ceiling azimuth coverage of this antenna it is necessary to place the antenna near to a corner of the box. It can be seen that these are conflicting requirements and the antenna position has been chosen to optimise performance in the two configurations. In both cases central position of the antenna in terms of basestation depth would optimise the orthogonality of the antenna patterns relative to antenna A.

Figure 5:
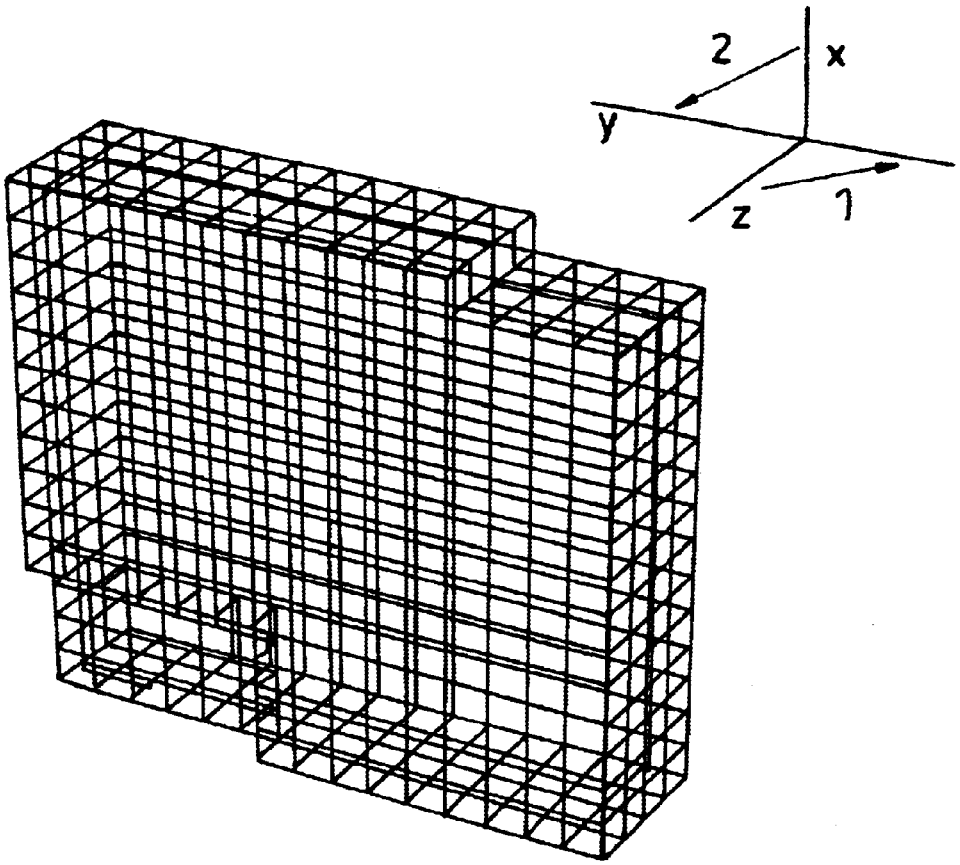
FIG. 5 shows a model of the antenna employed for simulations at 800 MHz.

A number of simulations have been performed. These simulations have also included modelling the effect which the heat sink fins have on radiation pattern performance. In general it has been found that a decrease in the number of heatsink fins improves the azimuth patterns. A compromise, to provide adequate cooling to the electronic and electrical circuits within the structure, resulting in a cut out section of 15 cm by 10 cm (6 by 4 inches) for Antenna A and a section 10 cm (4 inches) long covering the whole depth of the basestation for Antenna B, has been shown to provide acceptable antenna performance. The overall construction of the simulated basestation is shown in FIG. 5.

Figure 6:
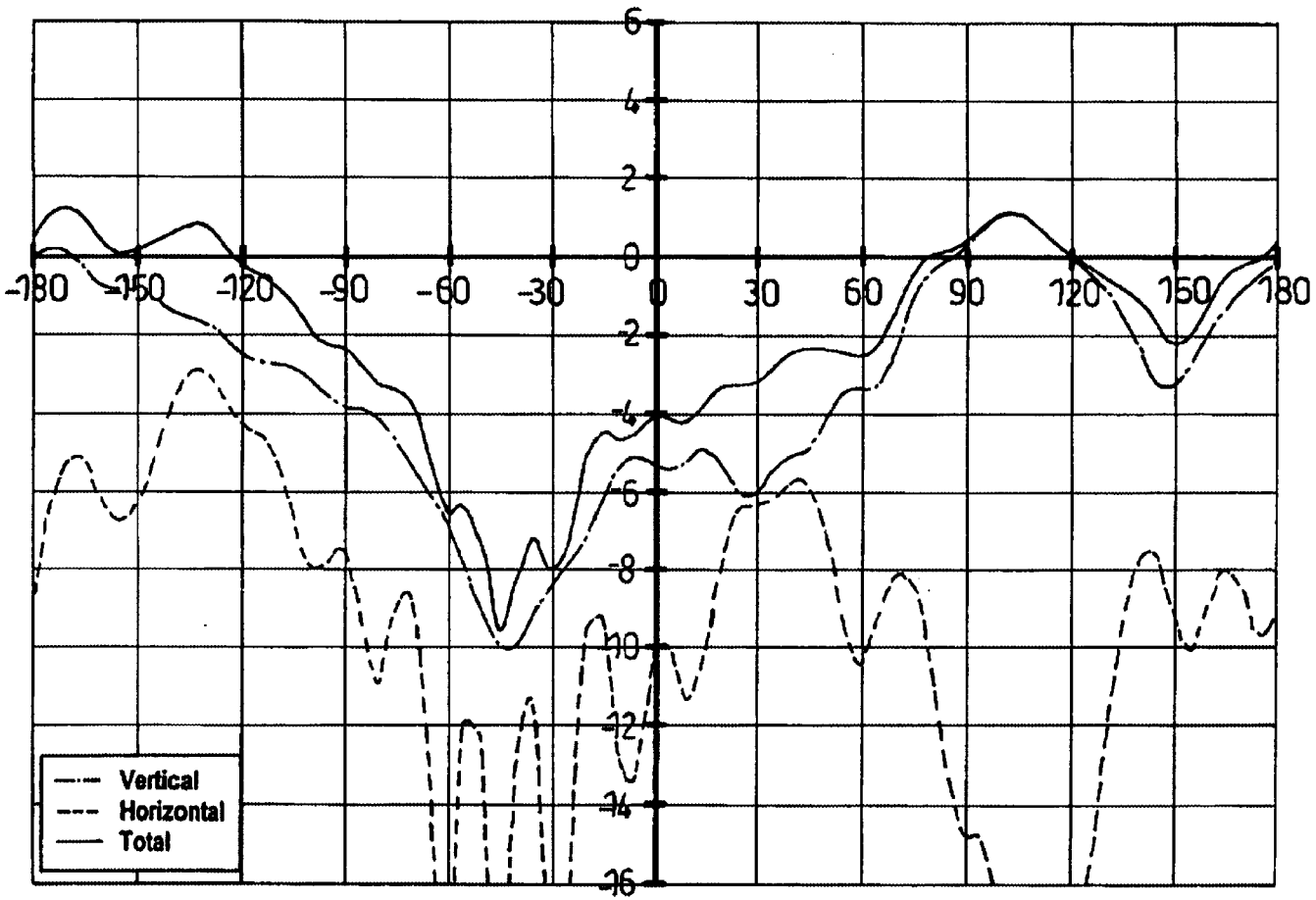
FIGS. 6–8 show modelled radiation patterns of the ceiling mounted configuration basestation at 1900 MHz.
Figure 7:
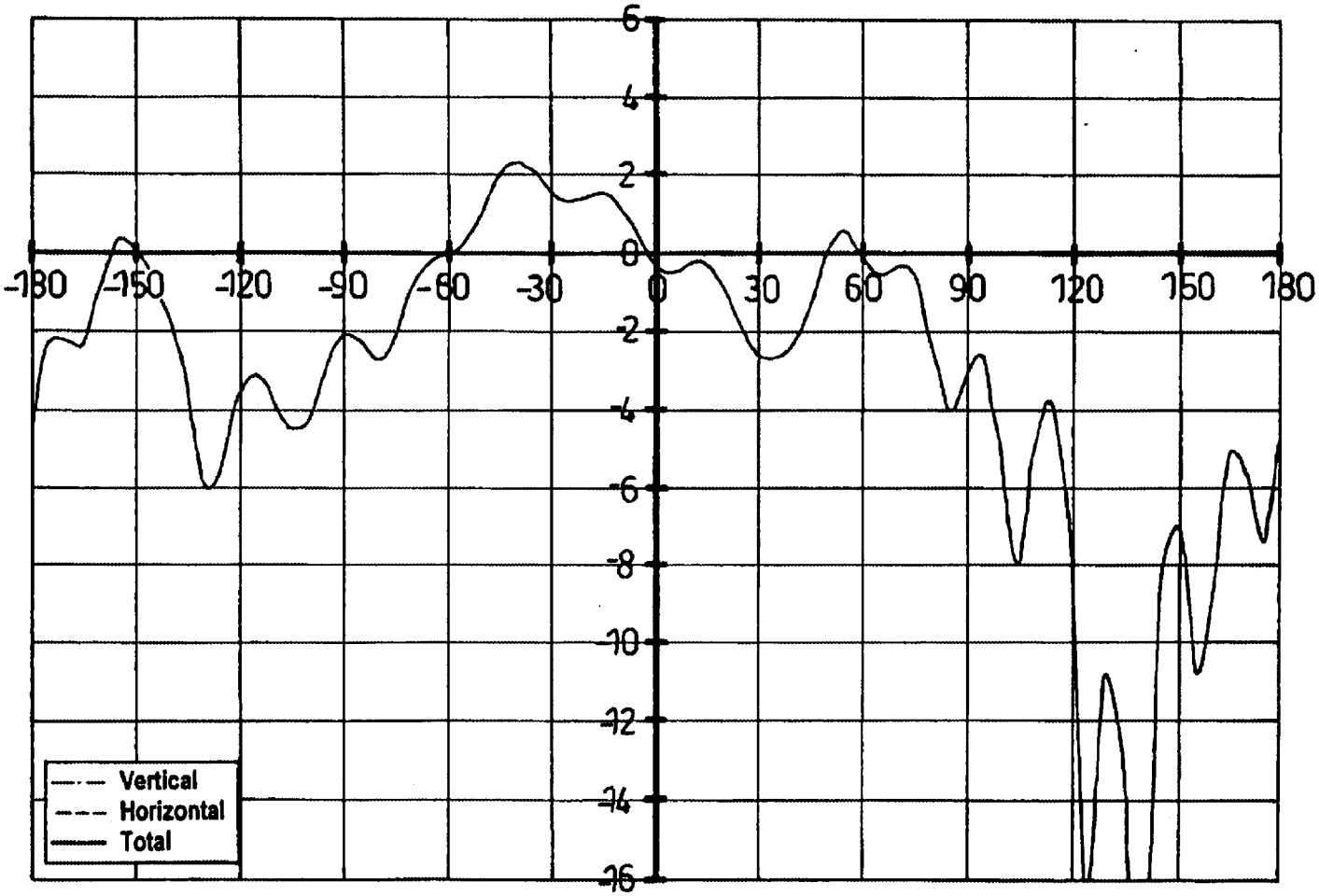
Figure 8:
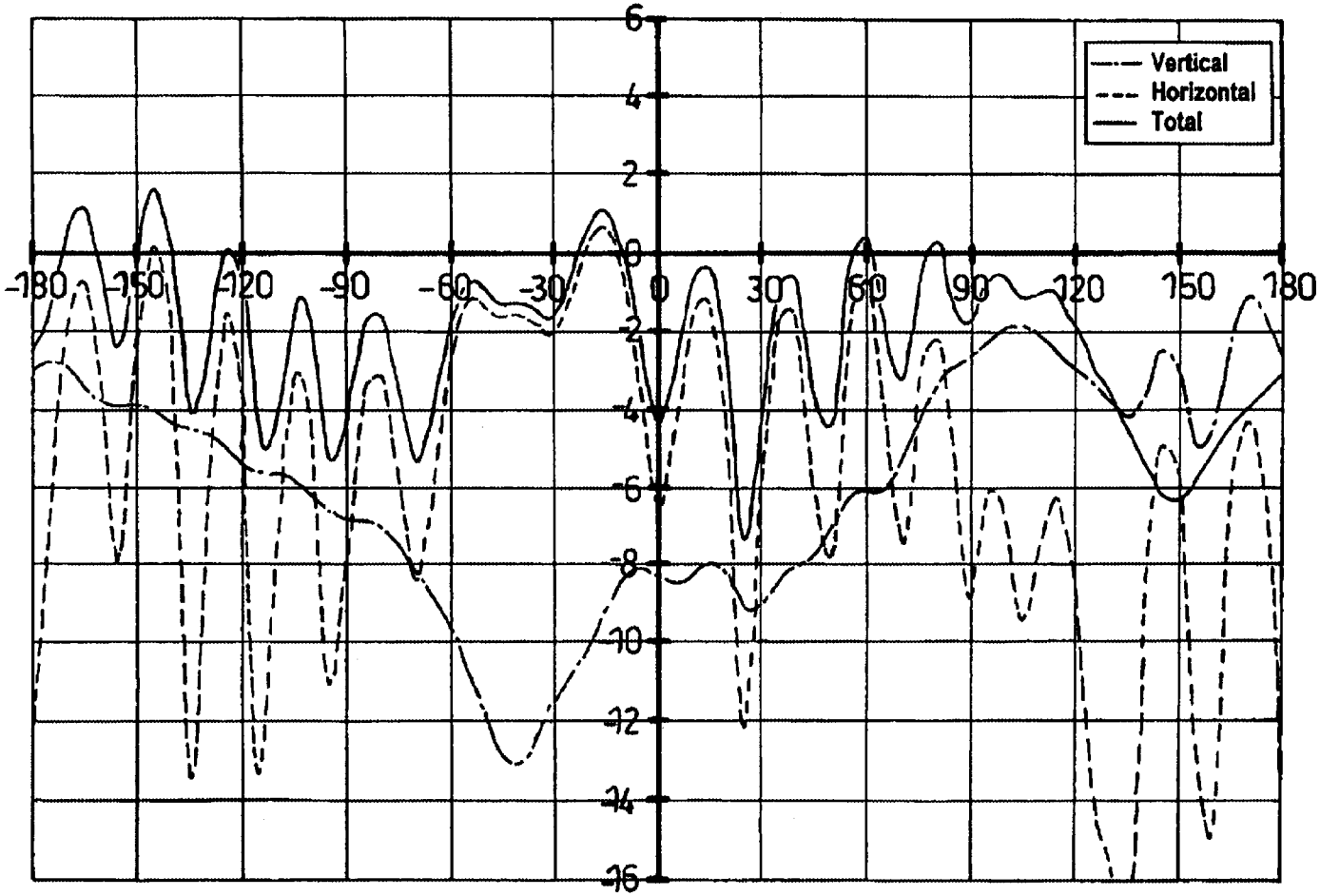
Figure 9:
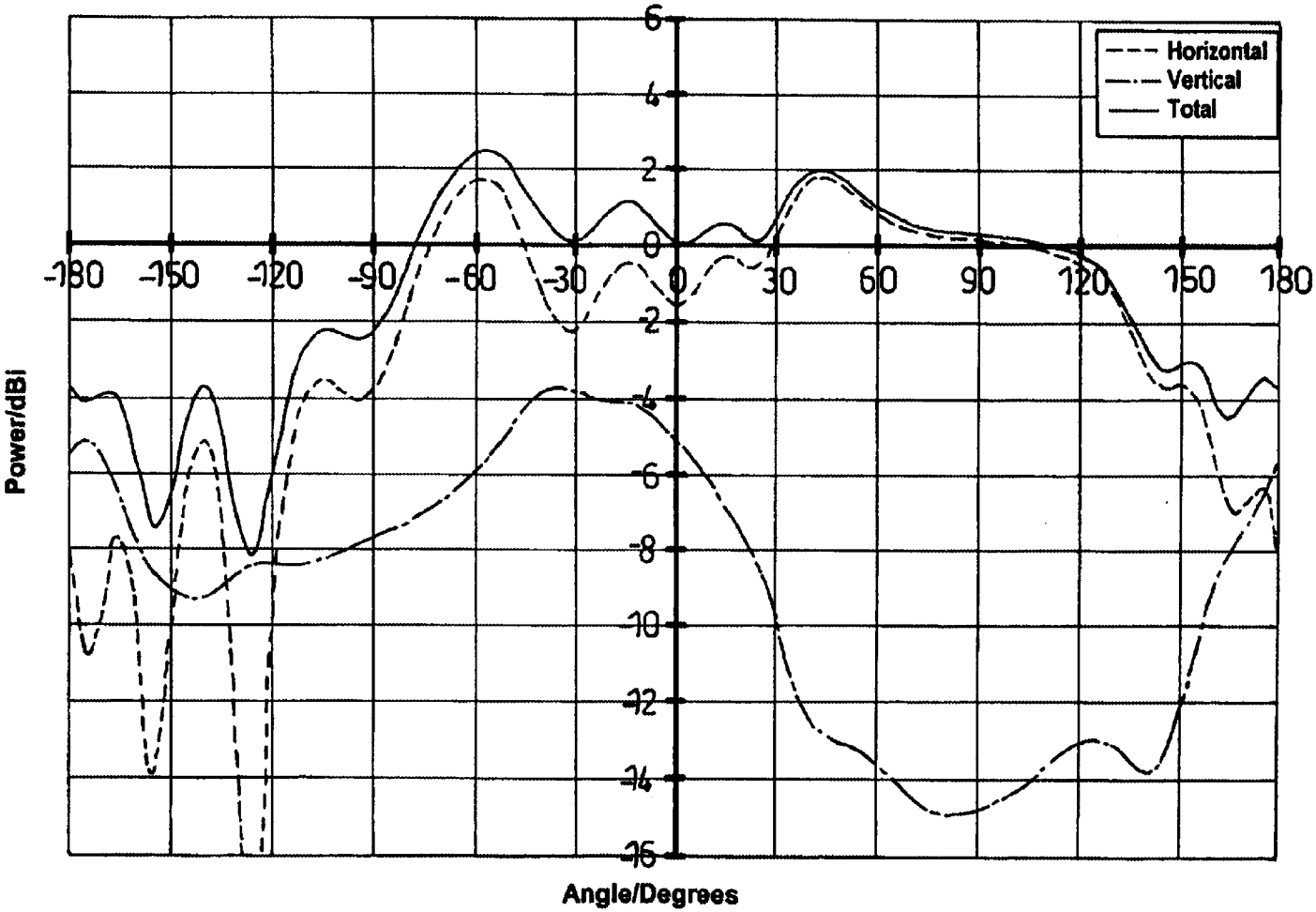
FIGS. 9–11 show modelled radiation patterns of the wall mounted configuration basestation at 1900 MHz.
Figure 10:
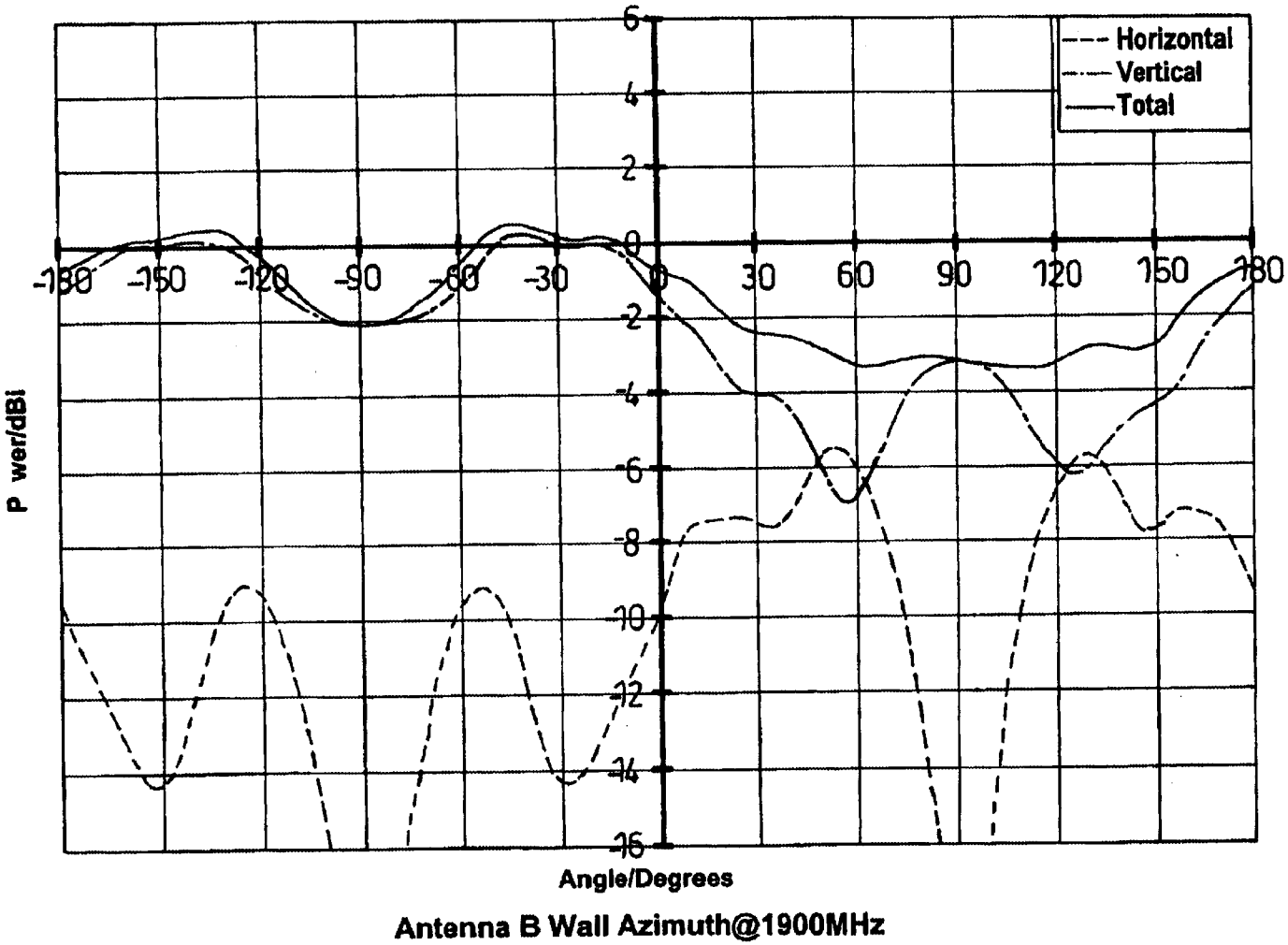
Figure 11:
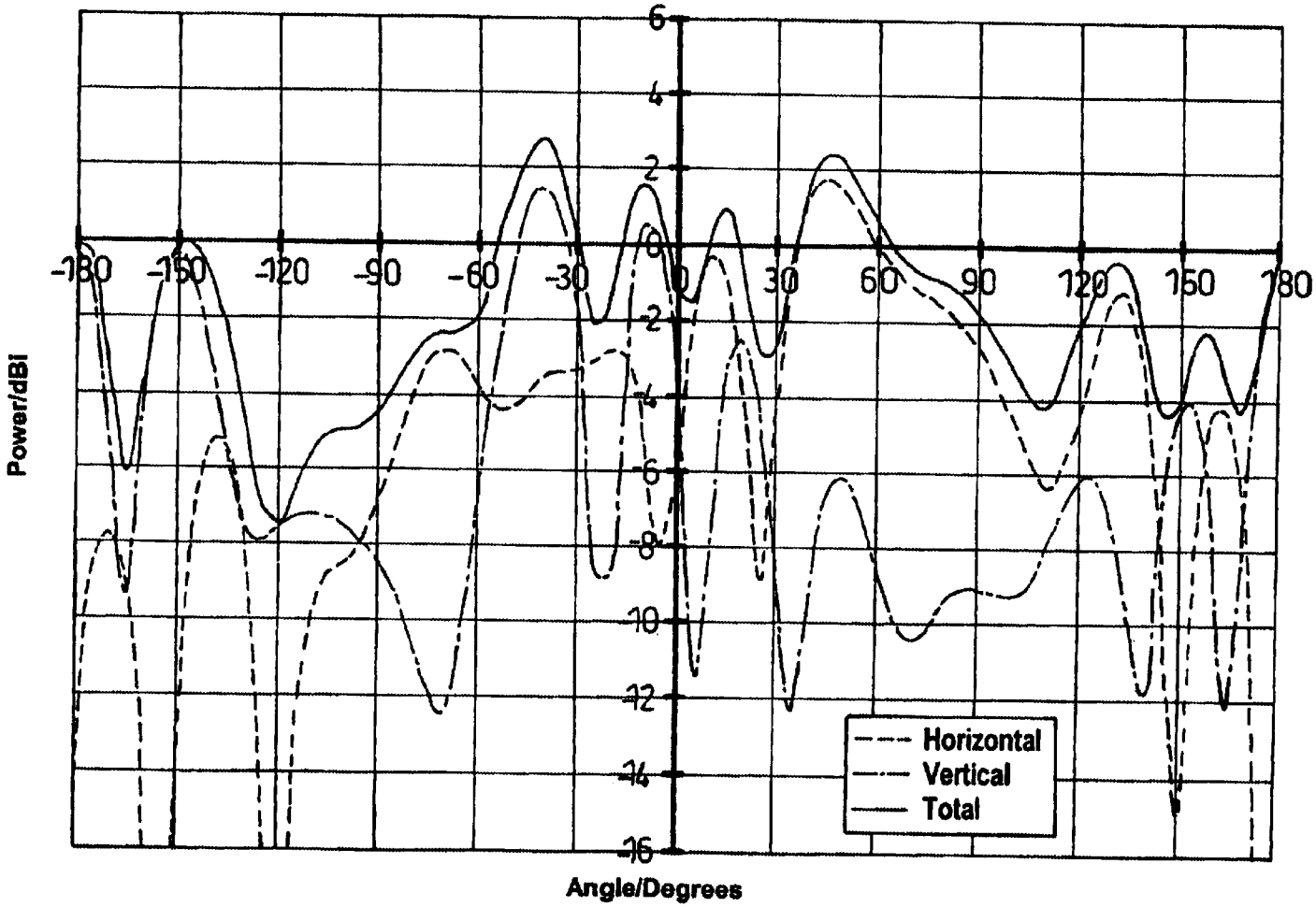

The modelled radiation patterns of the ceiling mounted basestation are shown in FIGS. 6 to 8. The performance has been modelled for both antennas in isolation and in combination, with the elements in phase. Similar results are presented for the wall mount configuration in FIGS. 9 to 11. The plots show both vertical and horizontal polarisation together with the power sum of the two polarisations. FIGS. 6 and 7 show that for the ceiling mounted case the coverage in the azimuth plane is generally acceptable for both antennas A and B. Both patterns have a null of approximately 10 dB however the sector for which the total gain on each antenna is below −5 dBi is approximately 45°. The two patterns are complementary, that is, when here is a null in one pattern in a particular direction, there is good performance in the other pattern in the same particular direction. The patterns are reasonably orthogonal and therefore when the antennas are combined the performance is very good. In the wall mount configuration, the performance of both antennas is acceptable in terms of omnidirectionality with antenna B performing particularly well. There is a null around the 60° direction for Antenna A, however the complementary nature of the patterns reduces the effect of this null. There is a good degree of orthogonality between the patterns and this results in a good azimuth coverage for the combined antennas as shown in FIG. 11.

Figure 12:
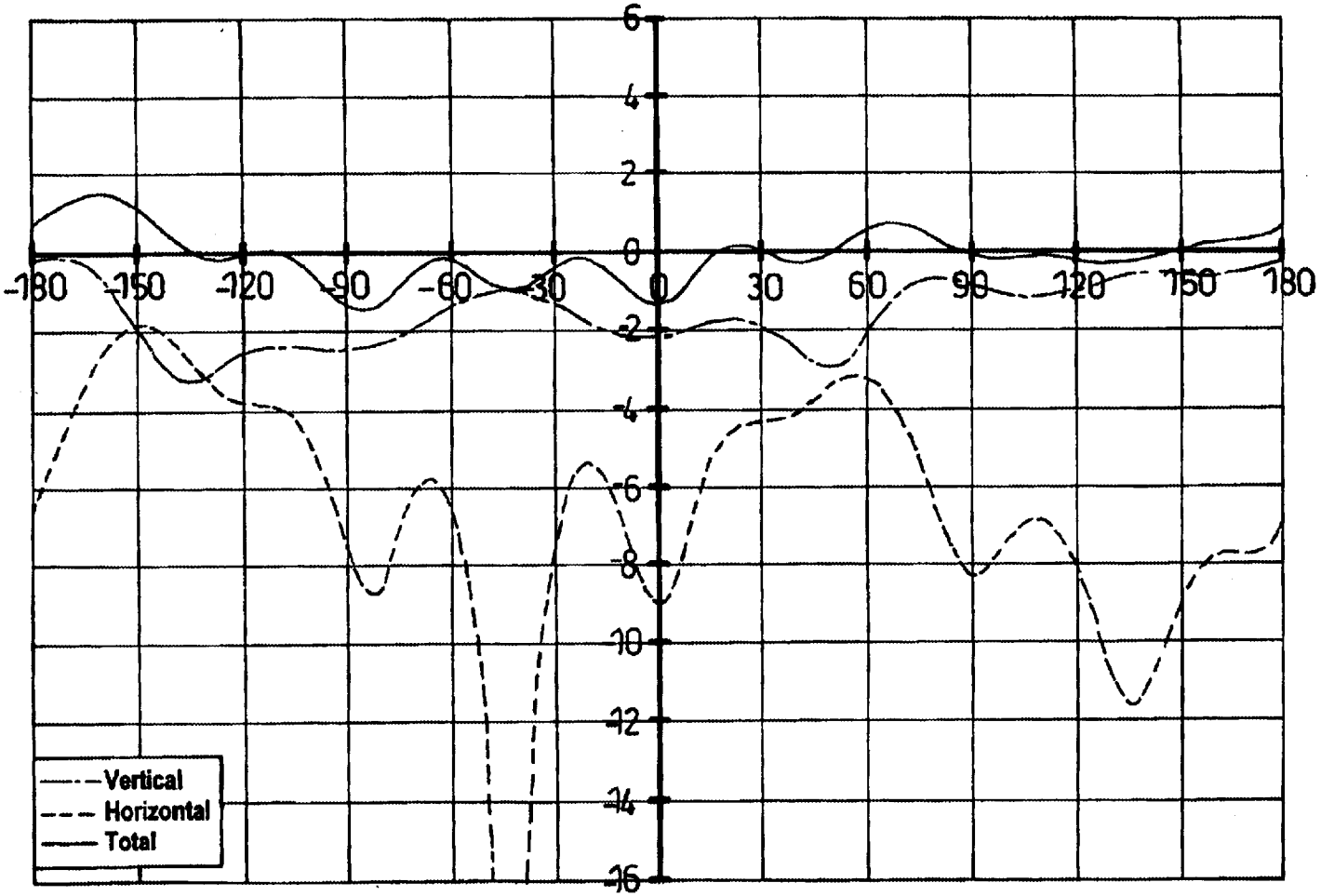
FIGS. 12 to 14 show modelled radiation patterns of the ceiling mounted configuration basestation at 800 MHz.
Figure 13:
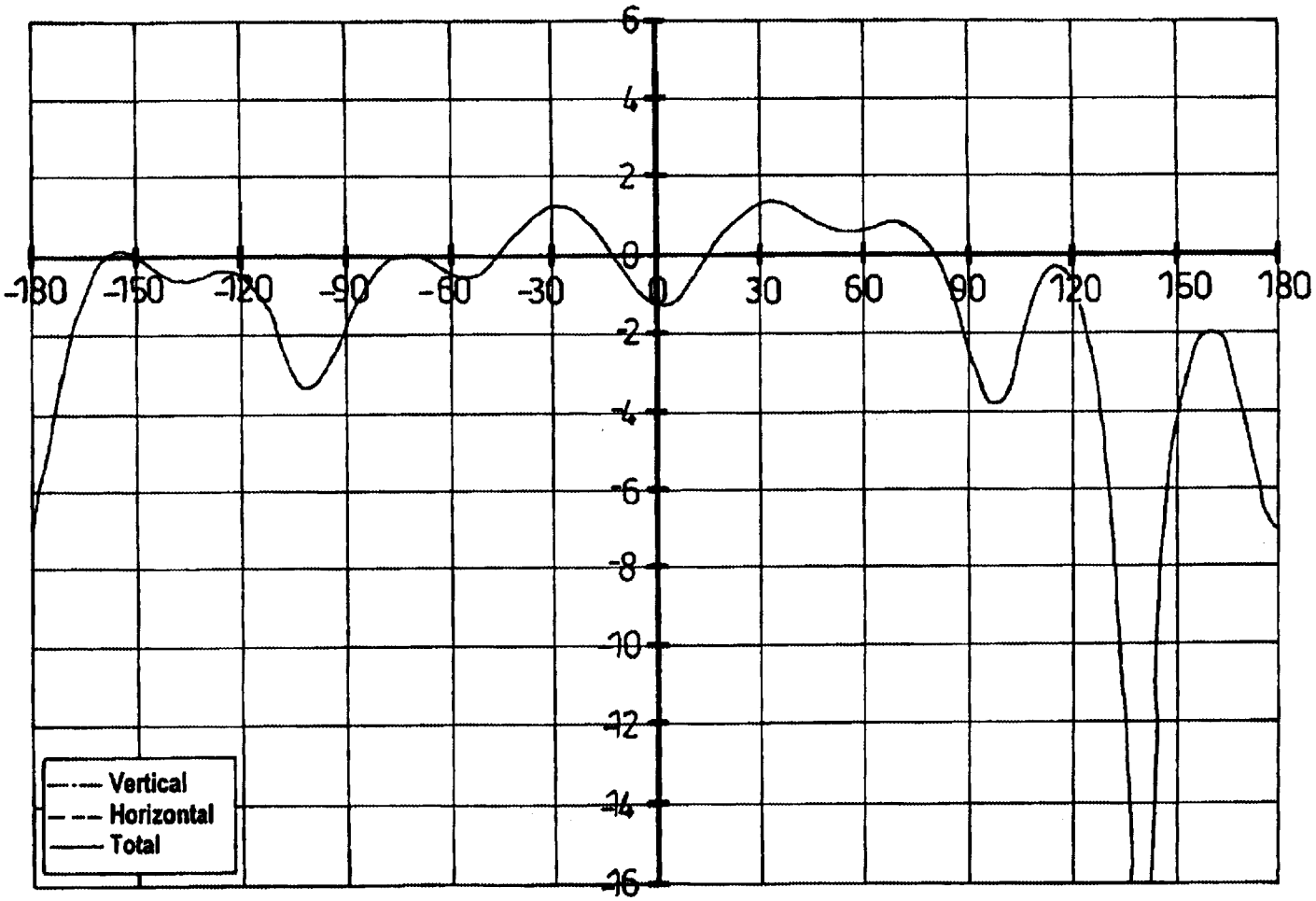
Figure 14:
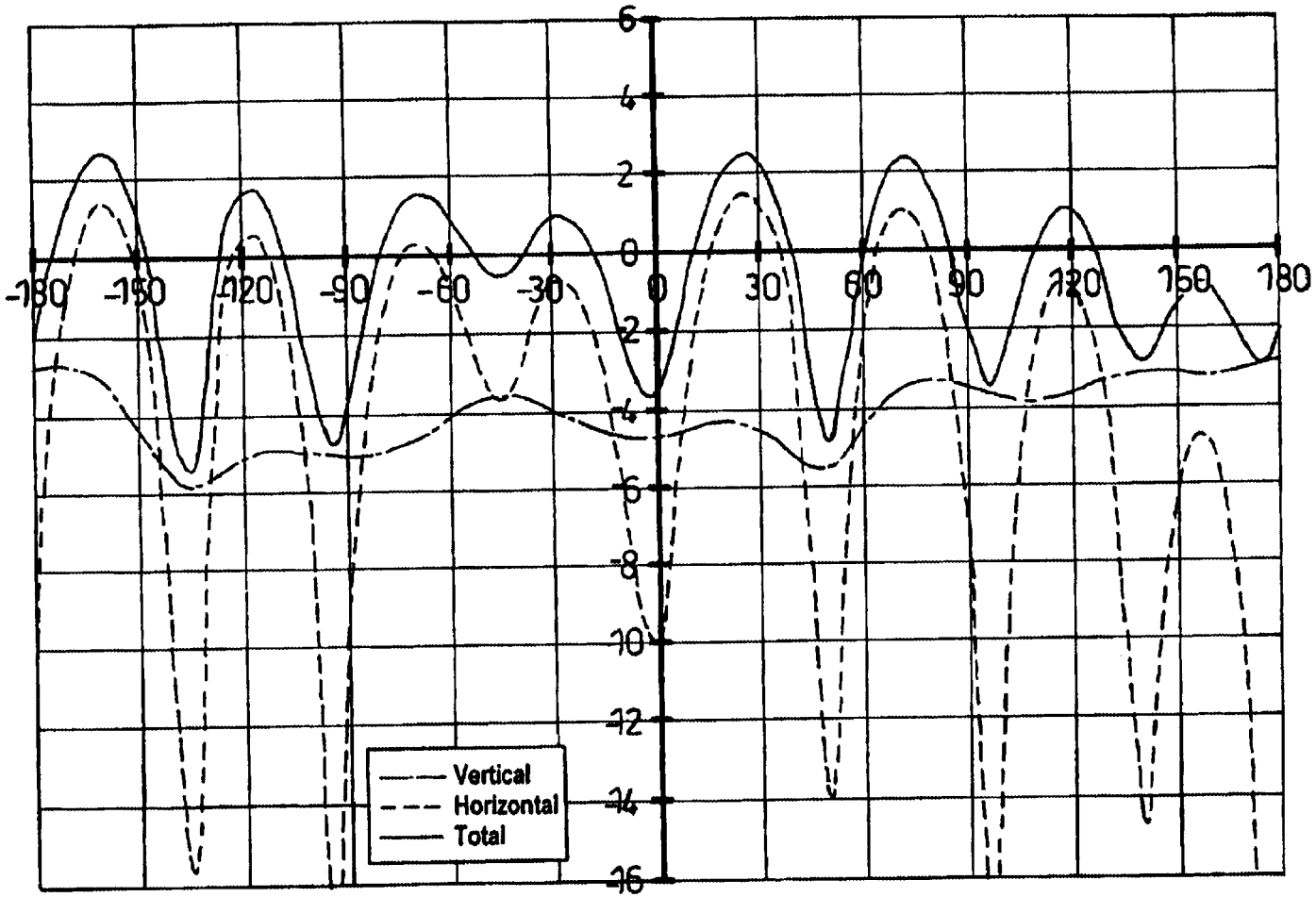
Figure 15:
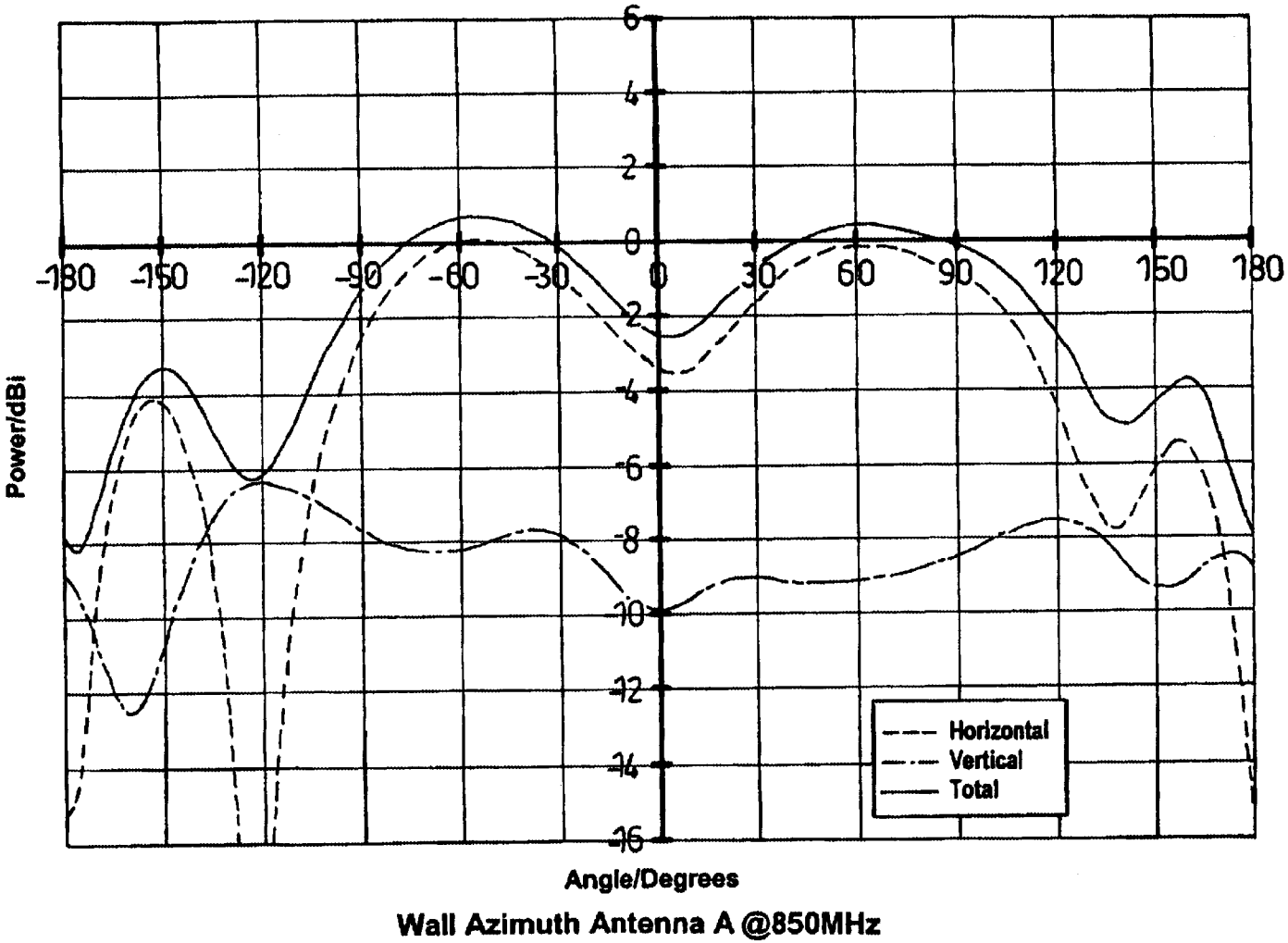
FIGS. 15 to 17 show modelled radiation patterns of the wall mounted configuration basestation at 800 MHz.
Figure 16:
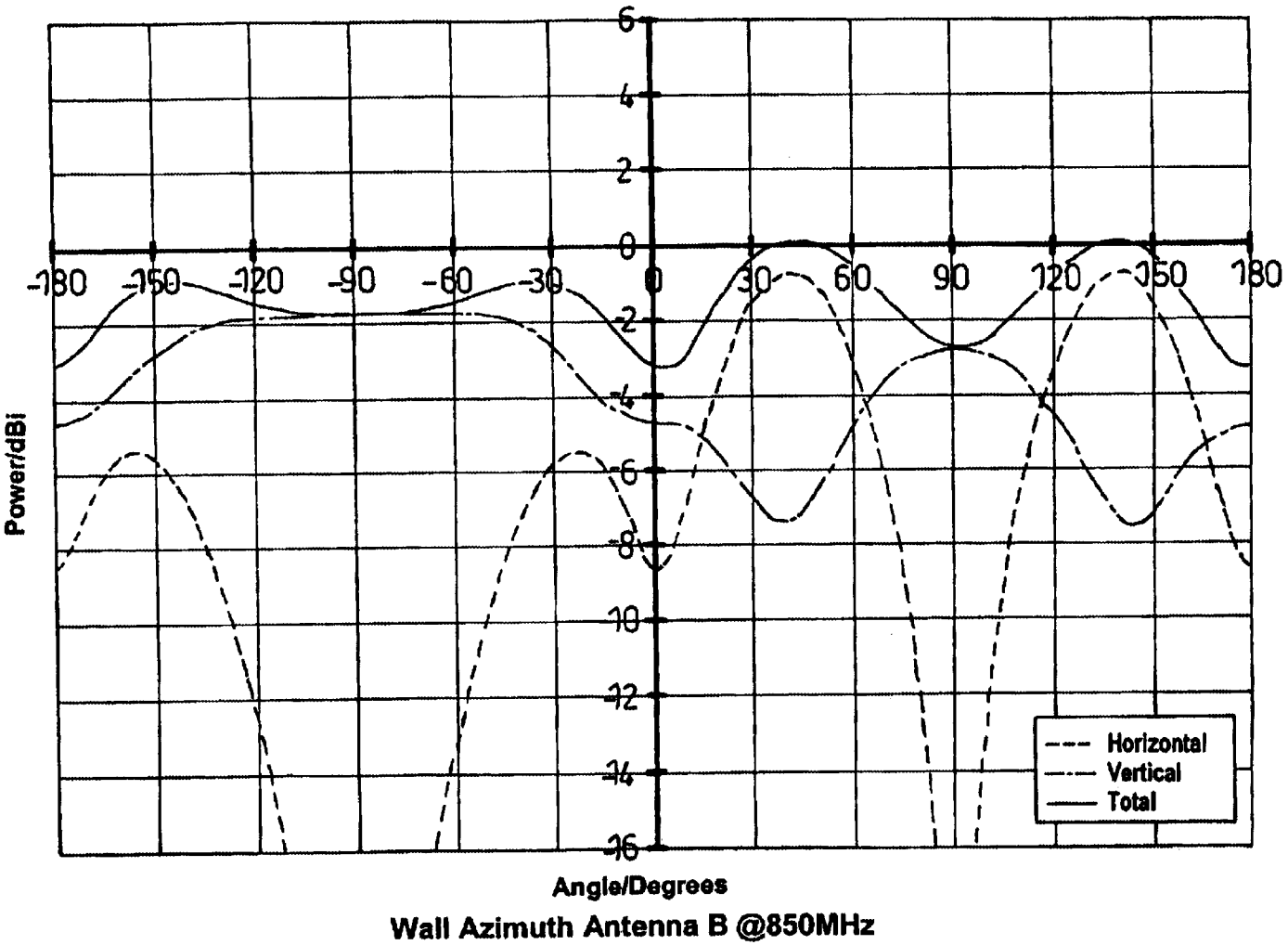
Figure 17:
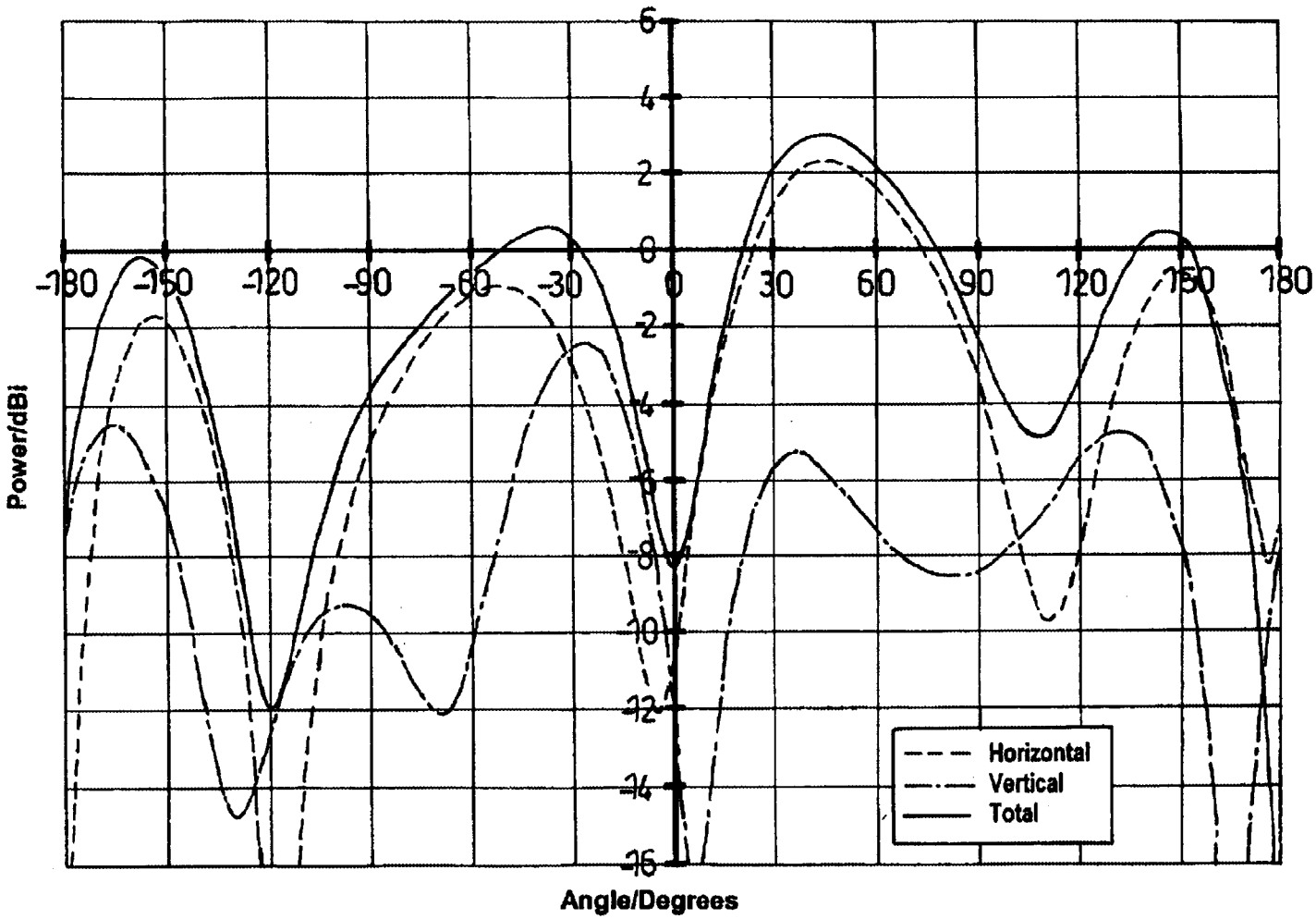
Figure 18:
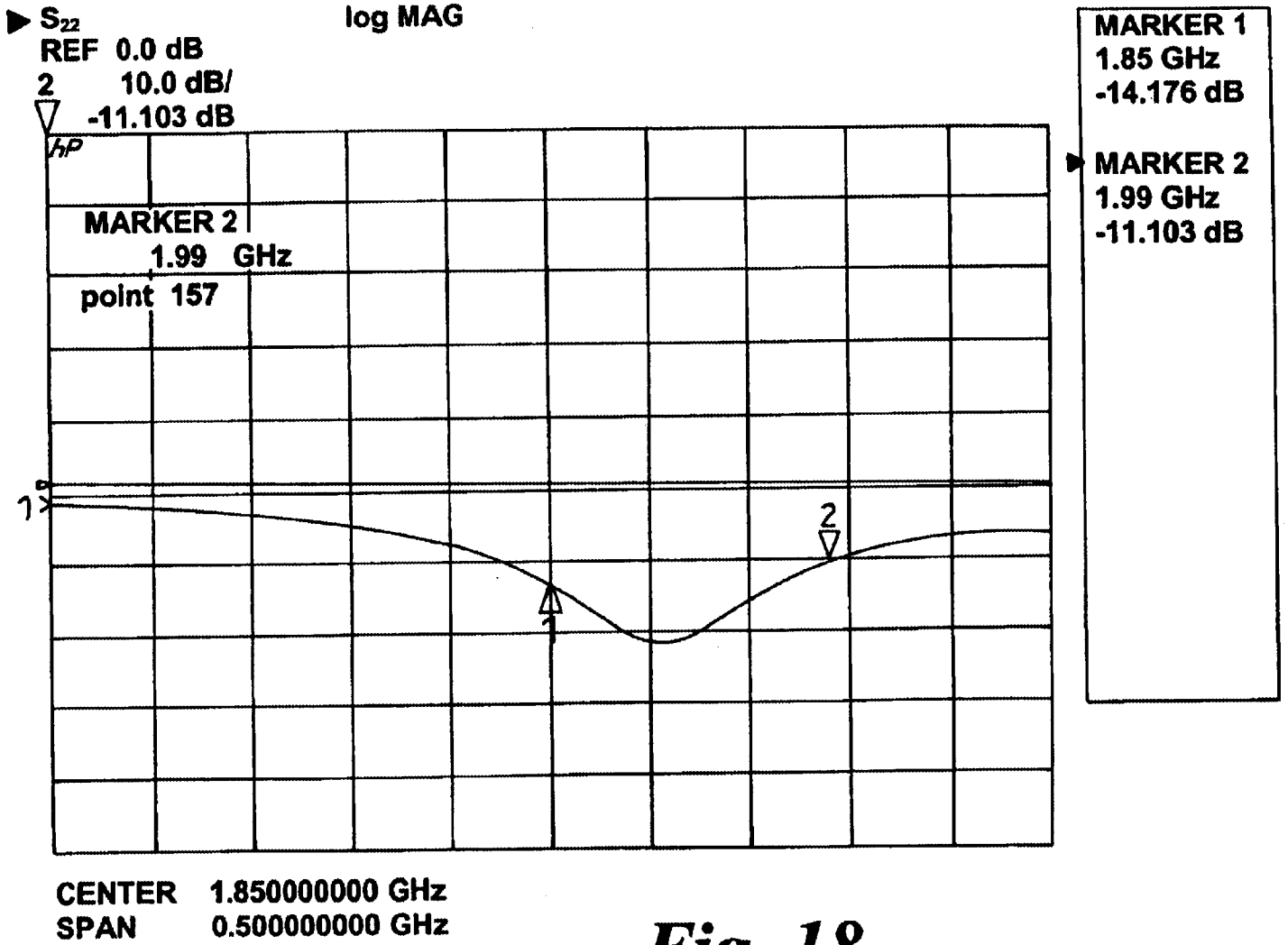
FIGS. 18–21 show the return loss of each individual element (both 1900 MHz and 800 MHz)
Figure 19:
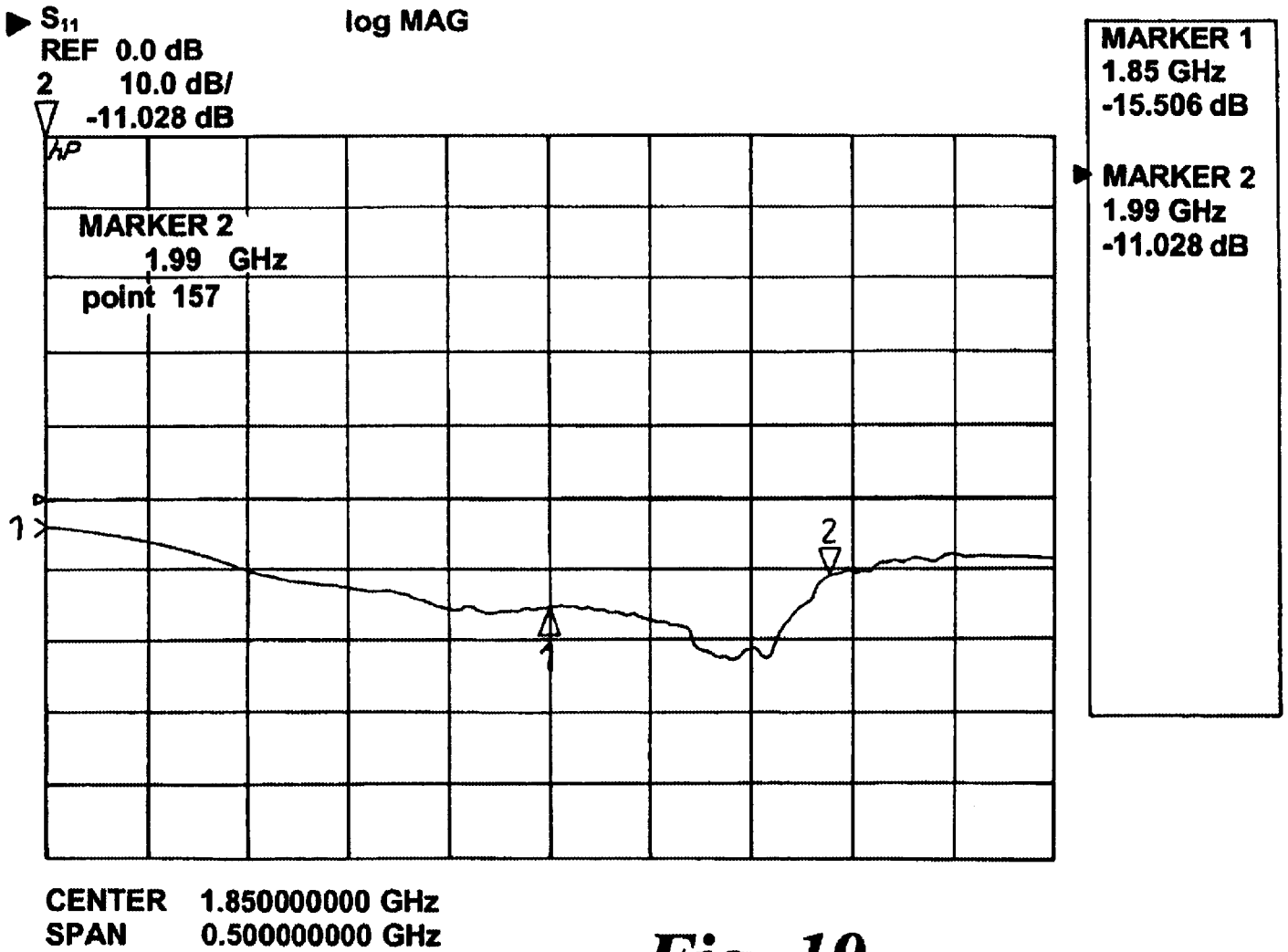
Figure 20:
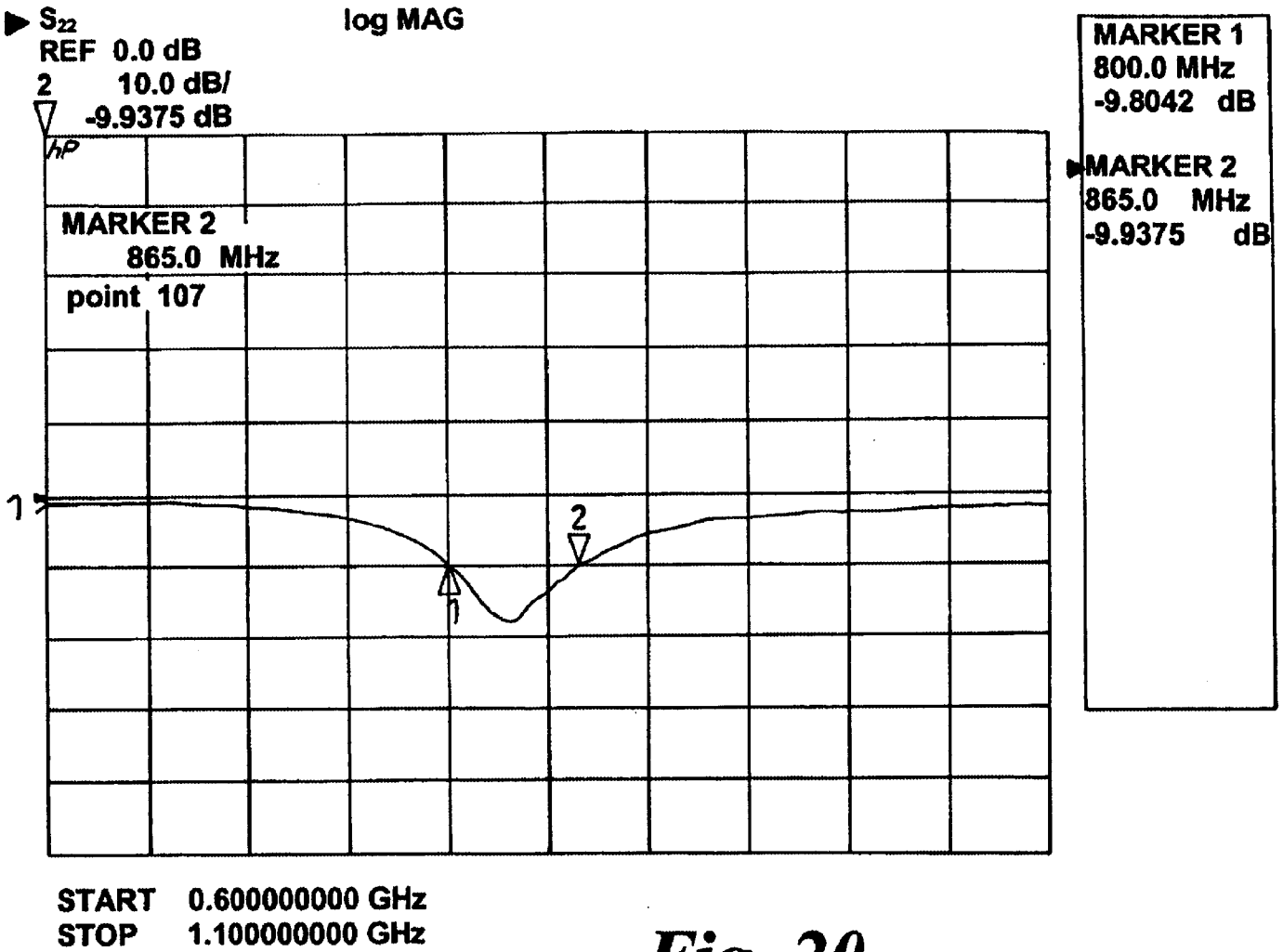
Figure 21:
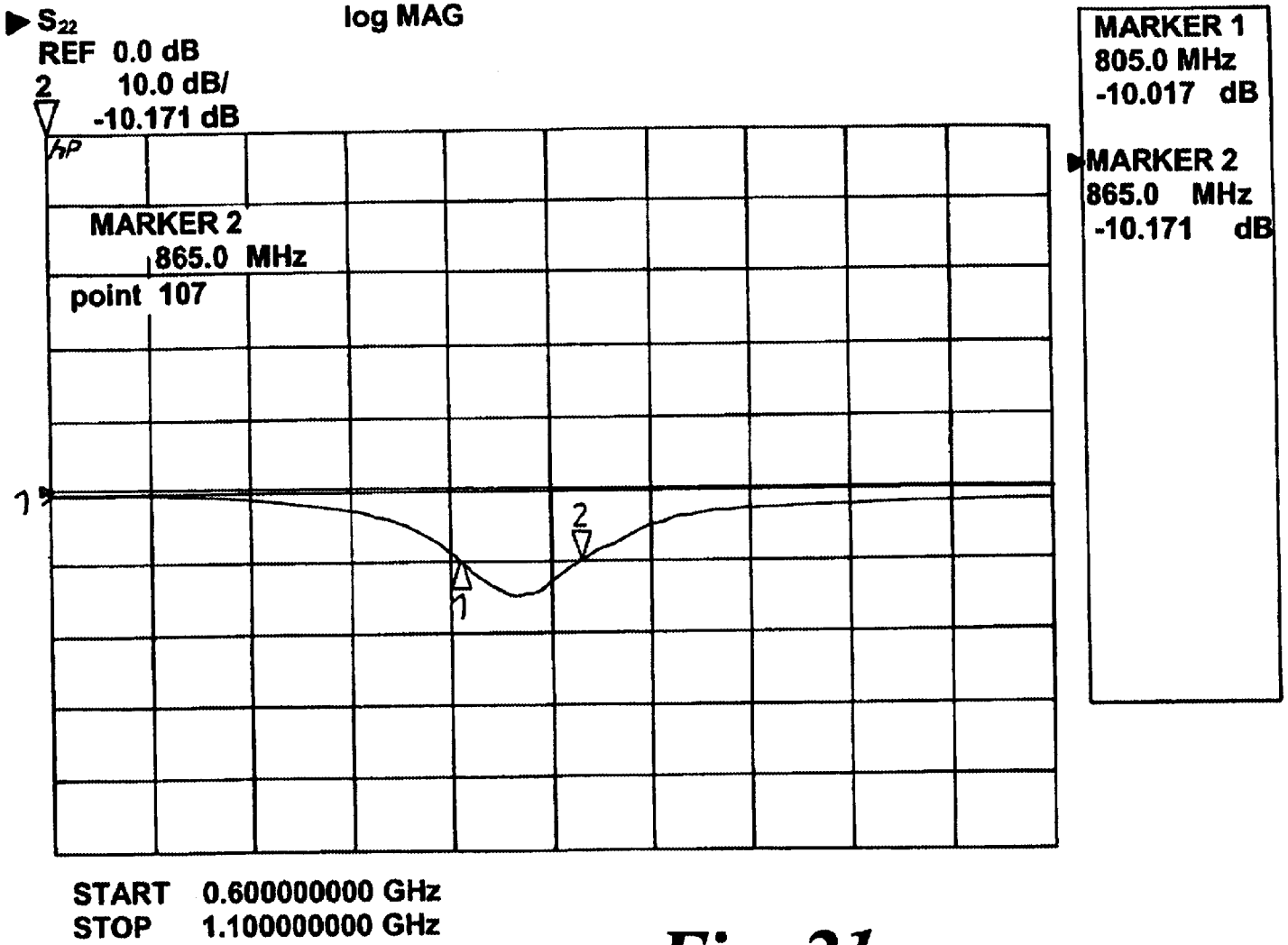

The antennas have been combined and the performance has been found to be acceptable in both the wall and ceiling mount configurations. FIGS. 12 and 13 show that the ceiling azimuth performance of the basestation is particularly good, with very omni-directional and orthogonal patterns for both antennas. Once again the symmetry of the basestation around antenna B serves to remove the vertical component of radiation from this antenna. The combined patterns are also very omnidirectional as shown in FIG. 14. Wall azimuth performance is also reasonably good as shown in FIGS. 15 and 16. Both antennas show omnidirectional coverage with a shallow null on antenna A. Whilst there are some partial nulls in the combined patterns, FIG. 17, the performance can be considered to be acceptable. Both ceiling and wall mount configurations benefit from the smaller basestation size in terms of wavelengths at 800 MHz. This improves omnidirectionality for the individual antennas. The necessity to fit the antennas into a smaller electrical volume does however mean that there is a larger horizontal component to antenna B. in the wall mount configuration. This increases the polarisation mixing and leads to the nulls in the azimuth plane when the antennas are combined.

Figure 22:
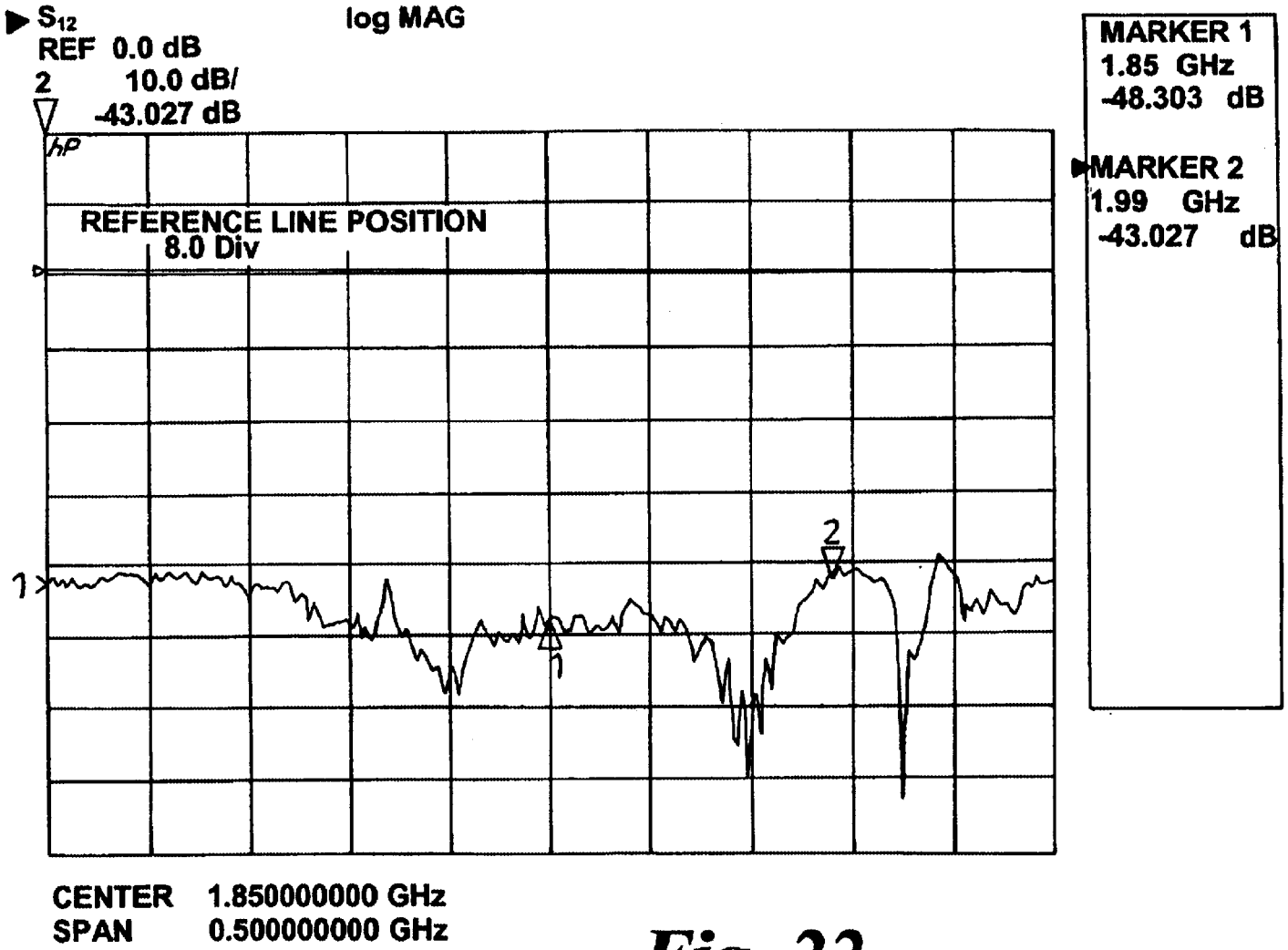
FIGS. 22 & 23 show the isolation between Antenna elements on the 1900 MHz and 800 MHz basestation respectively.
Figure 23:
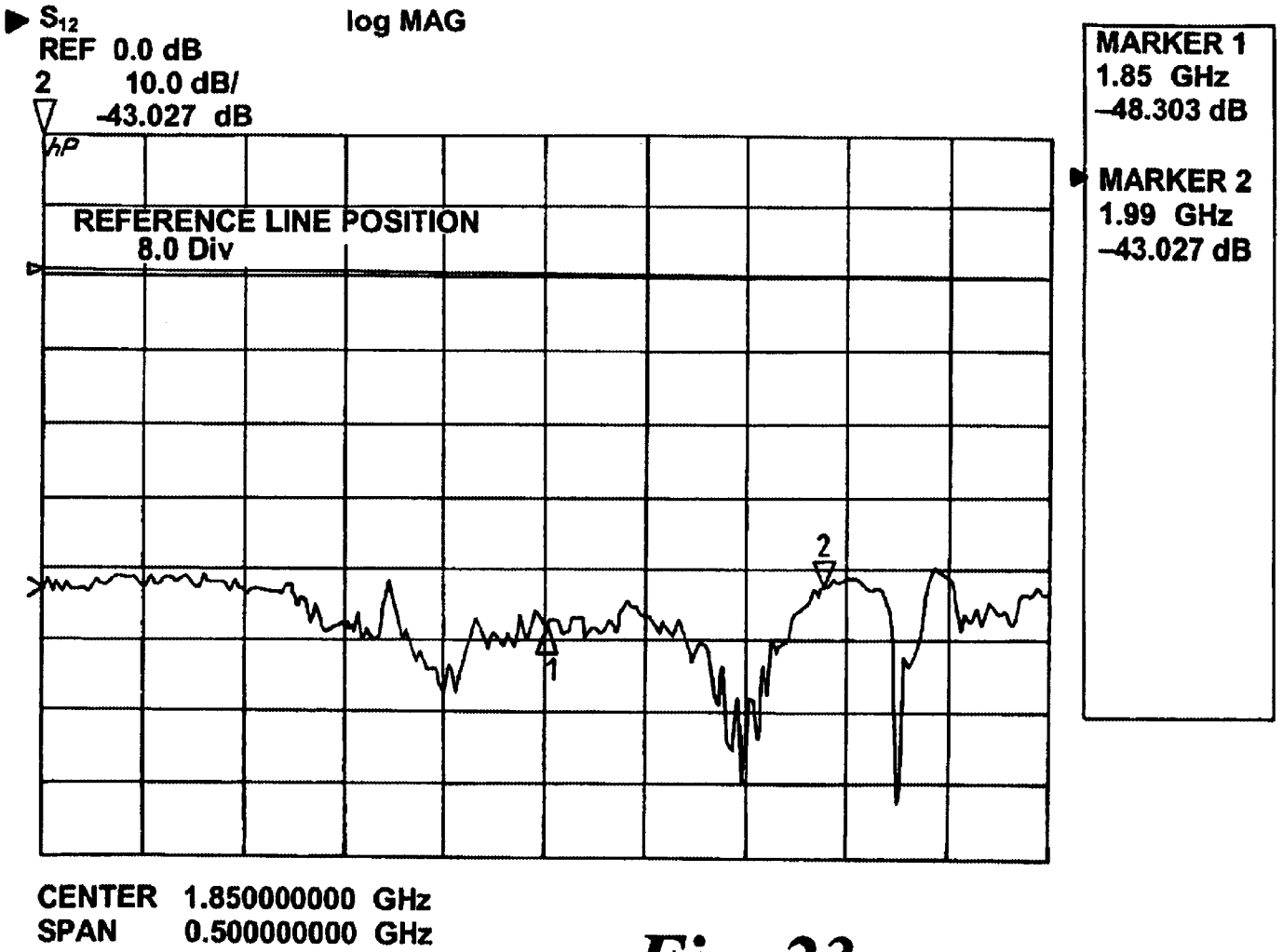

The return loss of each individual element (both 1900 MHz and 800 MHz) has been measured on the mock-up basestation. The results of these measurements are presented in FIGS. 18–21. The different electrical size of the groundplane around the positions of antennas A and B leads to the differences between the respective return losses for the elements. It can be seen that the bandwidth of the 800 MHz antenna does not cover the entire operating band. This is due to the restrictions placed on the height and width of the element. The isolation between the two antennas is shown in FIG. 22 for the 1900 MHz pair and FIG. 23 for the 800 MHz pair. It can be seen that the isolation between the elements is in excess of 30 dB for both cases.

Figure 24:
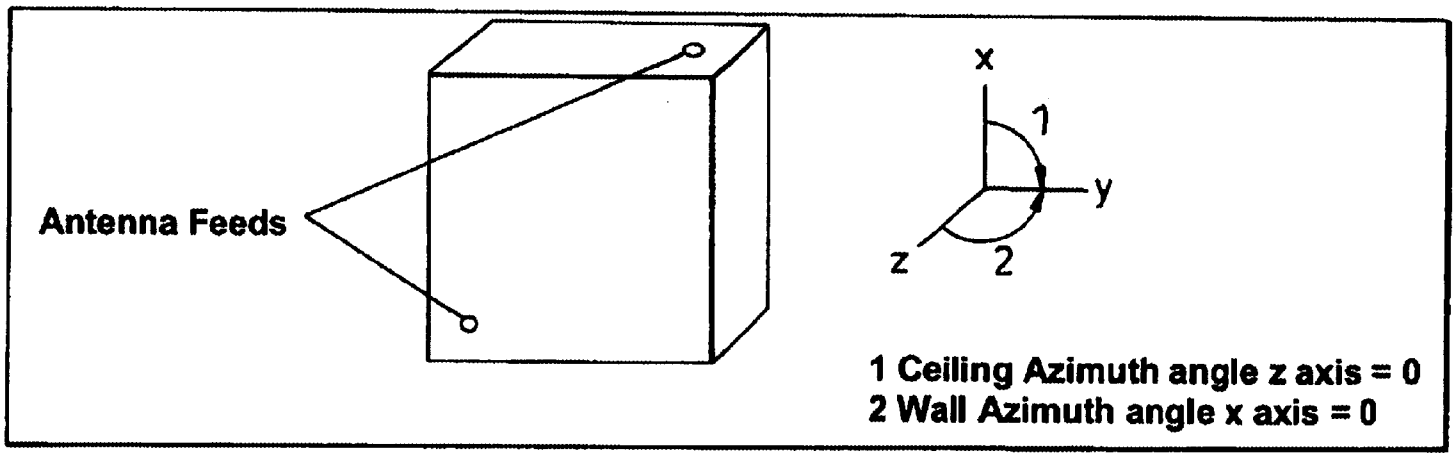
FIG. 24 shows the co-ordinate system used for the measurements.
Figure 25:
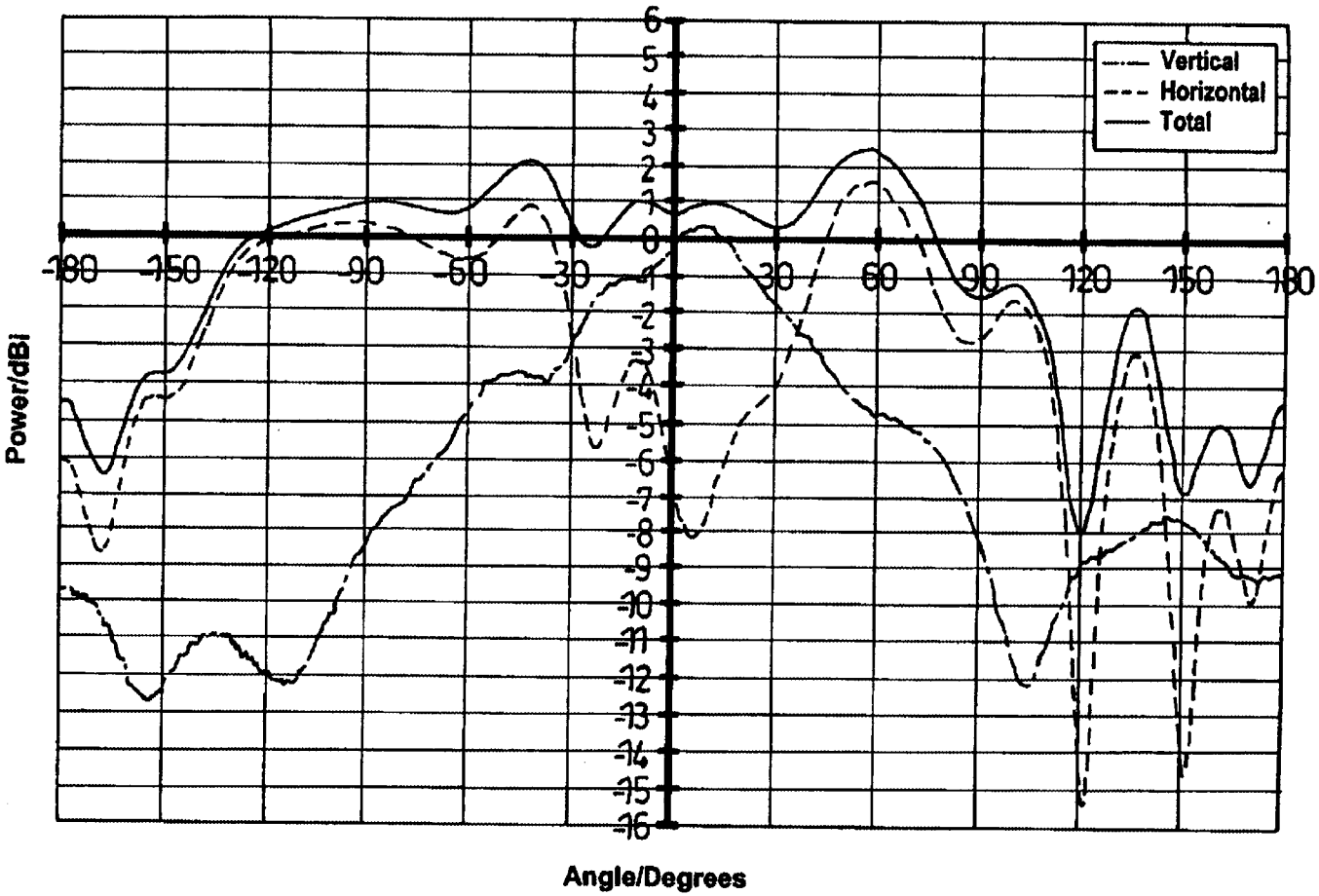
FIGS. 25 & 26 show modelled radiation patterns of the ceiling mounted configuration basestation at 1920 MHz.
Figure 26:
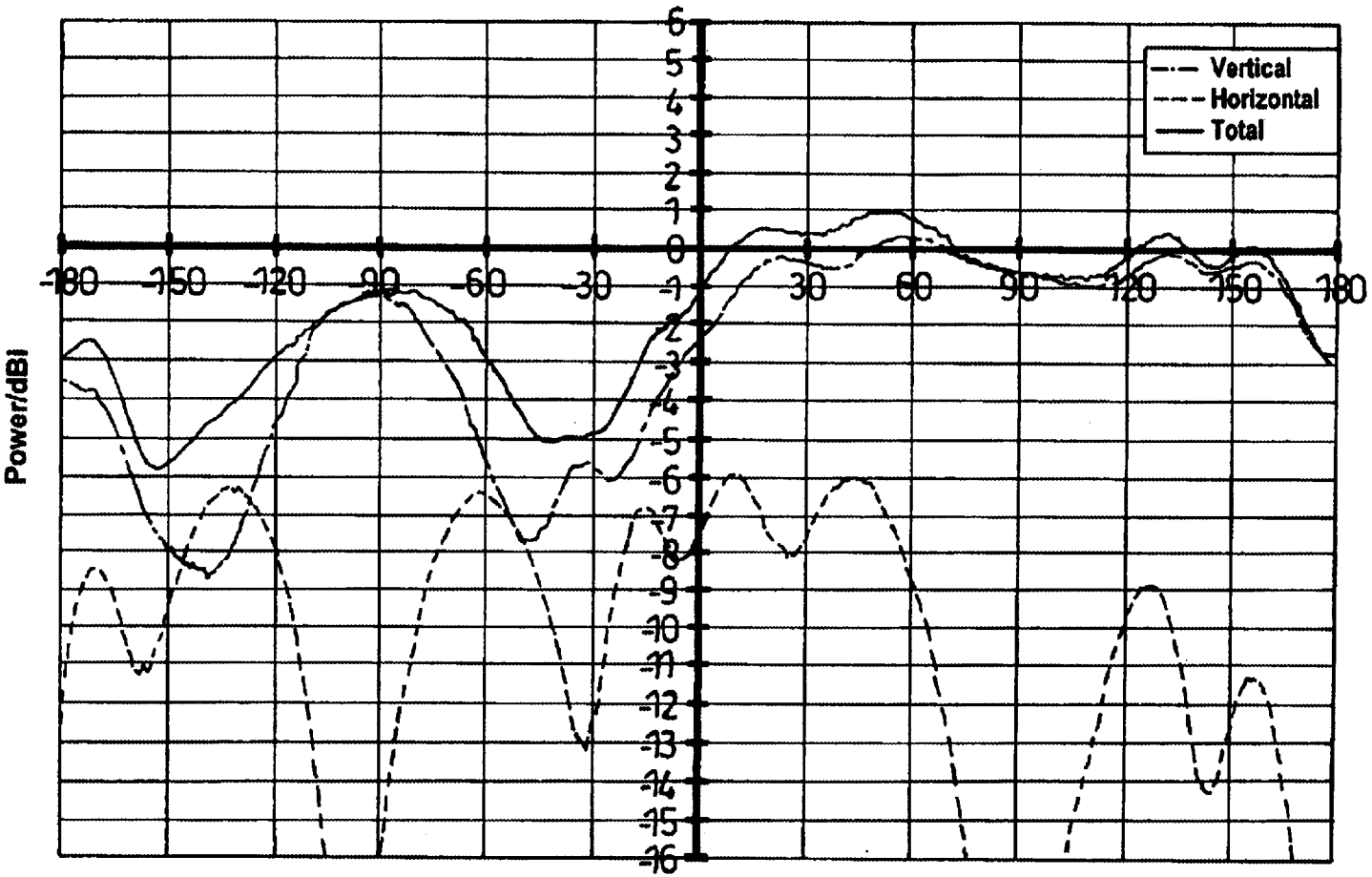
Figure 27:
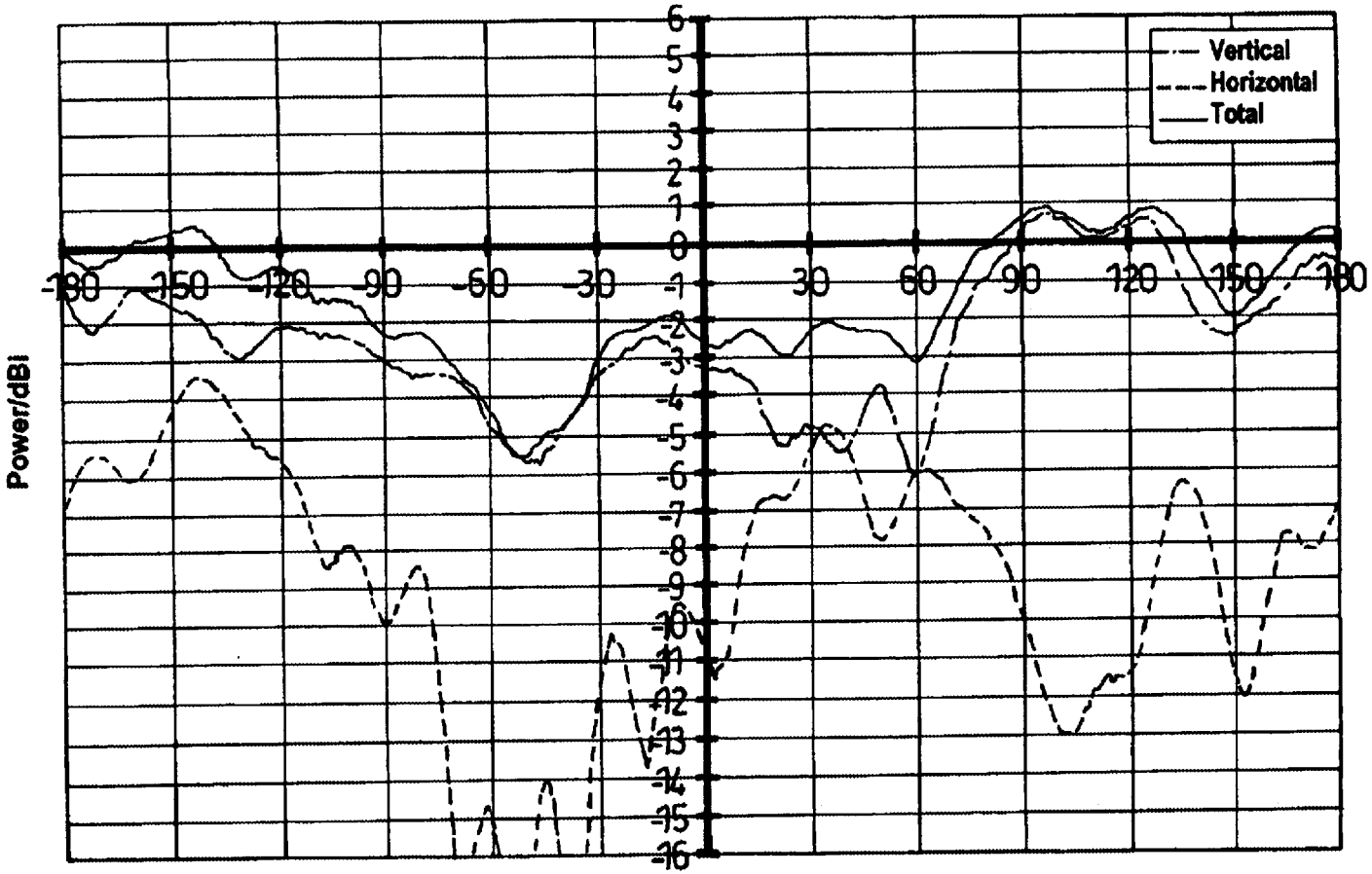
FIGS. 27 & 28 show modelled radiation patterns of the wall mounted configuration basestation at 1920 MHz.
Figure 28:
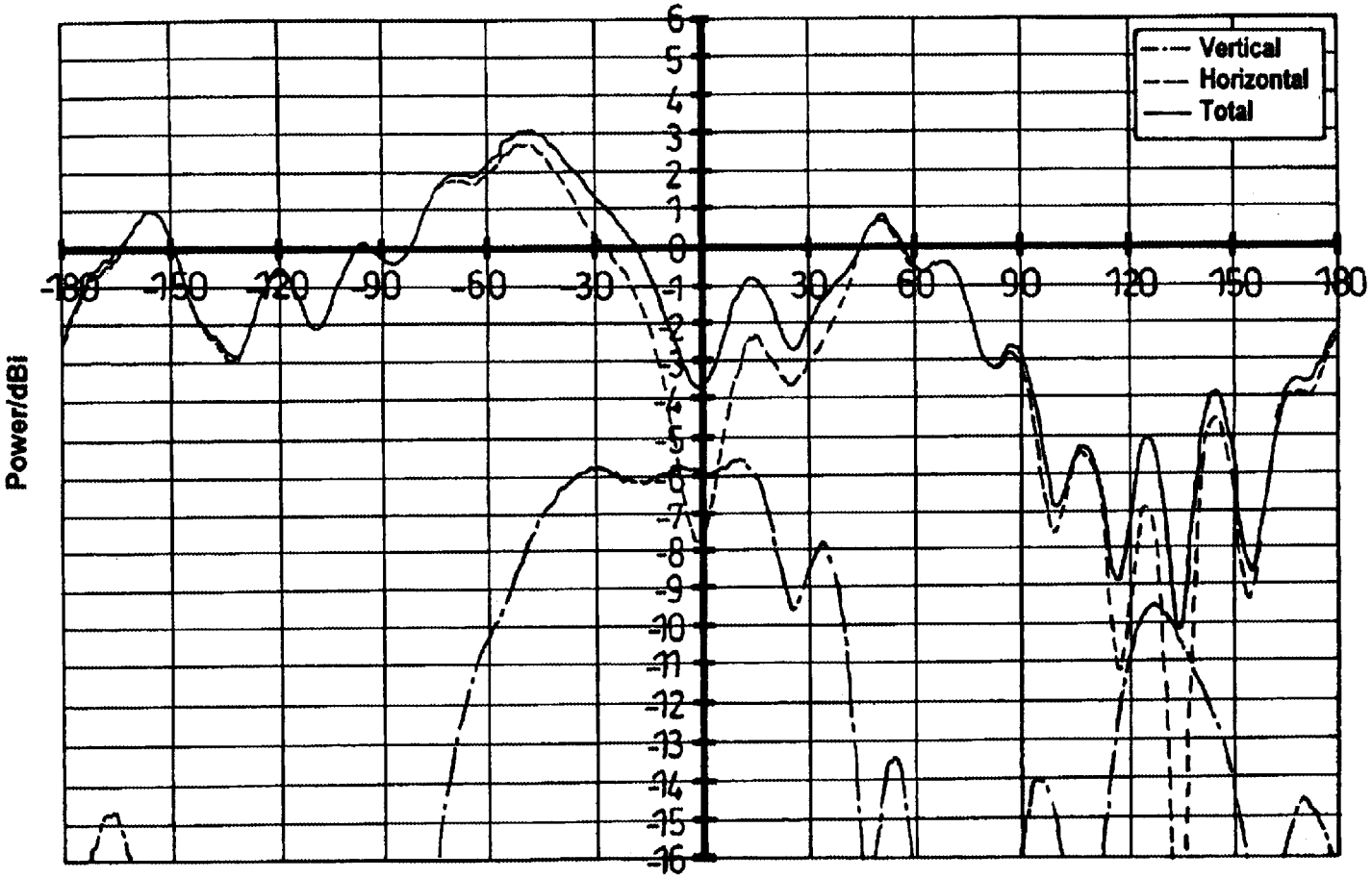
Figure 29:
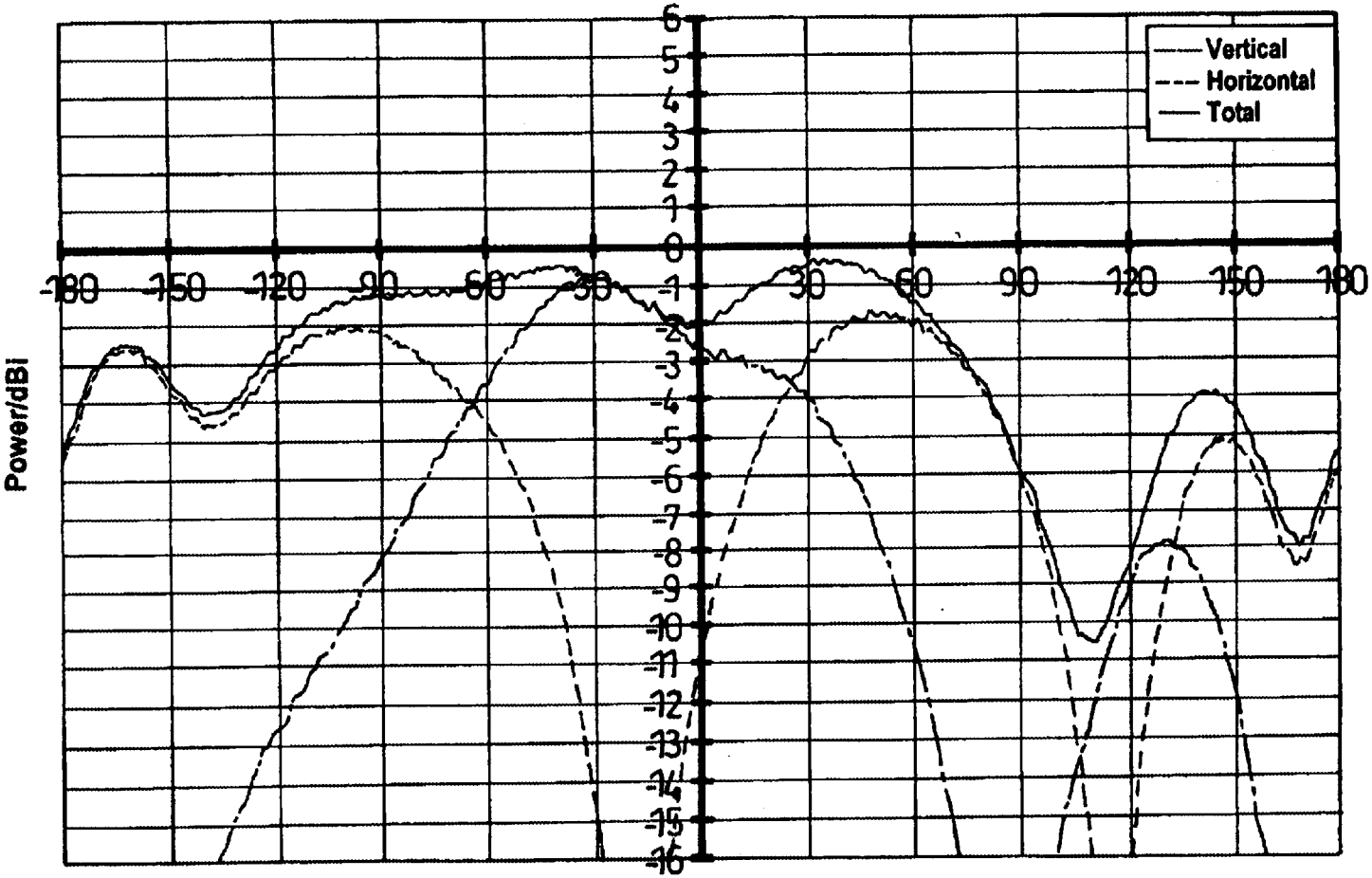
FIGS. 29–31 show modelled radiation patterns of the ceiling mounted configuration basestation at 850 MHz.
Figure 30:
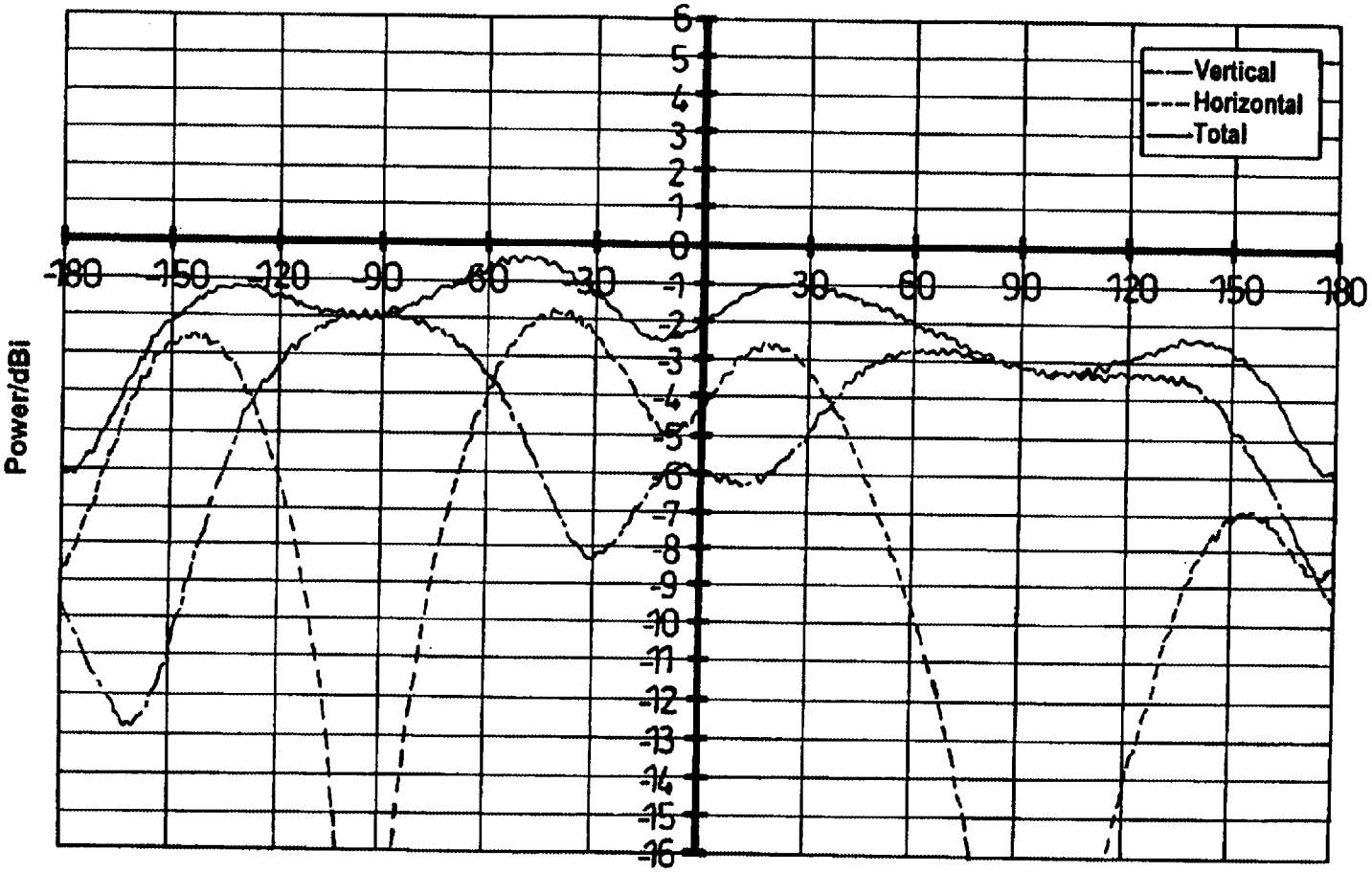

To confirm the modelled measurements at 1900 MHz actual test measurements have been obtained using a mock-up of a basestation as shown in FIG. 1. The mock-up was slightly larger than the current dimensions of the basestation measuring 36.5 cm×35 cm×8.7 cm (14.5"×14"×3.5"), and uses solid copper to simulate the heat sink fins. The increased size reflects an previous size for the basestation. The model serves to validate the modelled results since it is the placement of the antennas relative to the basestation edges which is the dominant factor. The co-ordinate system used for the measurements is shown in FIG. 24. This system is similar to that used for the modelling activity, however the wall mount rotation has been reversed. The results of the measurements at 1900 MHz are shown in FIGS. 25 & 26.

The measurements of the single antennas show an acceptable degree of omnidirectionality and orthogonality. There is also a good correspondence between the modelled and measured patterns. For Antenna B a similar front to back ratio (3–4 dB) is observed for the wall mount case and corresponding nulls at 120° for the ceiling mount case. In the ceiling mount measurements Antenna A shows some evidence of the modelled null at −60° in the measurements. For the wall mount case the measured front to back ratio (4–5 dB) is larger than that found from the modelling (3–4 dB), but can be attributed to the increased mock-up basestation size for the measured results. Generally the cross polar level measurements were increased relative to the modelled patterns. This effect can be clearly seen when comparing the ceiling azimuth patterns for antenna B where the measured cross polar signal increases to around −6 dBi at the 0° point. This is most likely to be due to the feed cables and the planar nature of the measured elements (the modelled patterns were produced from bent monopoles). Generally these increases are small and the correspondence between the measurements and models are good. For the measurements of combined antennas it can be seen that once again the omnidirectionality of the patterns are good. The wall mount cases show a front to back ratio of approximately 3–4 dB, this being caused by the large electrical size of the basestation. It is more difficult to compare the modelled and measured combined antenna patterns, although a similar mean gain and general structure are obtained. Table 1 shows that the mean azimuth plane gains for both the single antennas (uplink) and the combined antennas (downlink) are acceptable. It should be noted that the combined patterns include the loss of a hybrid (approximately 0.5 dB). This loss has been accounted for in the adjusted gain column in order to get the true gain.

Cable losses have not been calibrated out in these figures. It is also useful to note the effect which reversing the phase of the elements has on the mean azimuth level. Accordingly, it is possible to fine tune this parameter to maximise average gain.

A subset of the measurements are presented here to show the effect of the physical restrictions on the 800 MHz element. The results of the radiation pattern measurements are shown in FIGS. 27 to 34. The measurements are not in the operating band of the basestation due to a mistuning of the antenna element. The return loss is reflected in the average azimuth radiation pattern level which is generally depressed at this frequency. The radiation pattern in general appear to be a strong function of frequency implying that the box dimensions are critical to performance. It is believed that this is because the basestation is approximately a wavelength square at 800 MHz. Given that the basestation range is downlink limited it may be useful to optimise this antenna element for the transmit band. At 850 MHz the ceiling performance of antenna A is acceptable with a fairly linearly polarised pattern with a good omnidirectional pattern. In the wall mount configuration this element suffers from a pattern with relatively high polarisation mixing. This is due to the long horizontal segment of the antenna and its placement on the basestation. However the average level is good in the sector +/−90 degrees. Antenna B shows a high level of polarisation mixing in the wall mount case. This is to be expected and is due to the large horizontal portion of the element. It is useful to note that a similar level of mixing occurs if the element is mounted on the basestation side rather than the top. This implies that the non-symmetric antenna placement is also an important factor. Again this element suffers from a strong front to back ratio, with coverage being predominantly +/−90°. In the Ceiling mount configuration Antenna B is predominantly horizontally polarised and has an omnidirectional pattern with high average gain.

Figure 31:
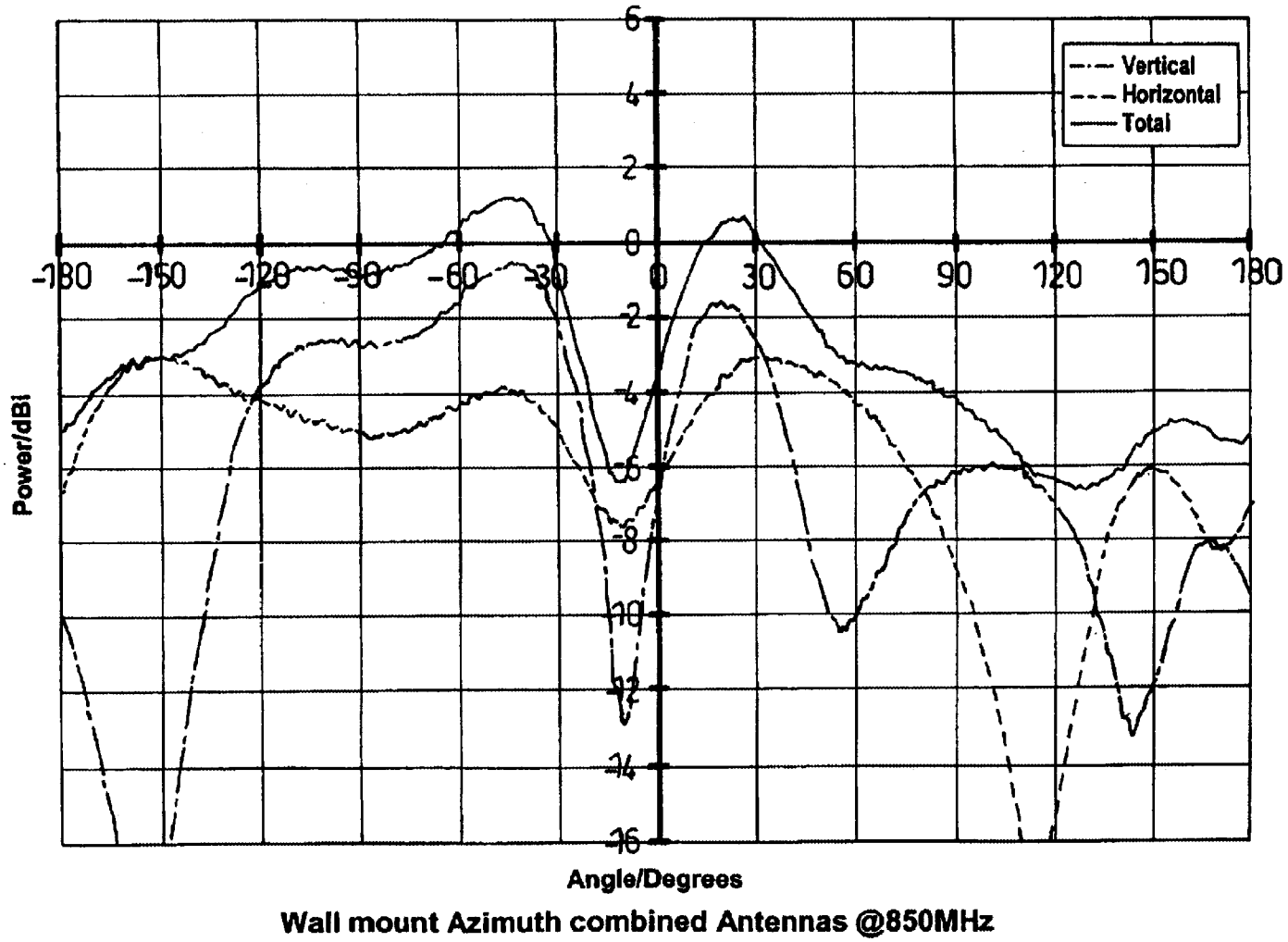
Figure 32:
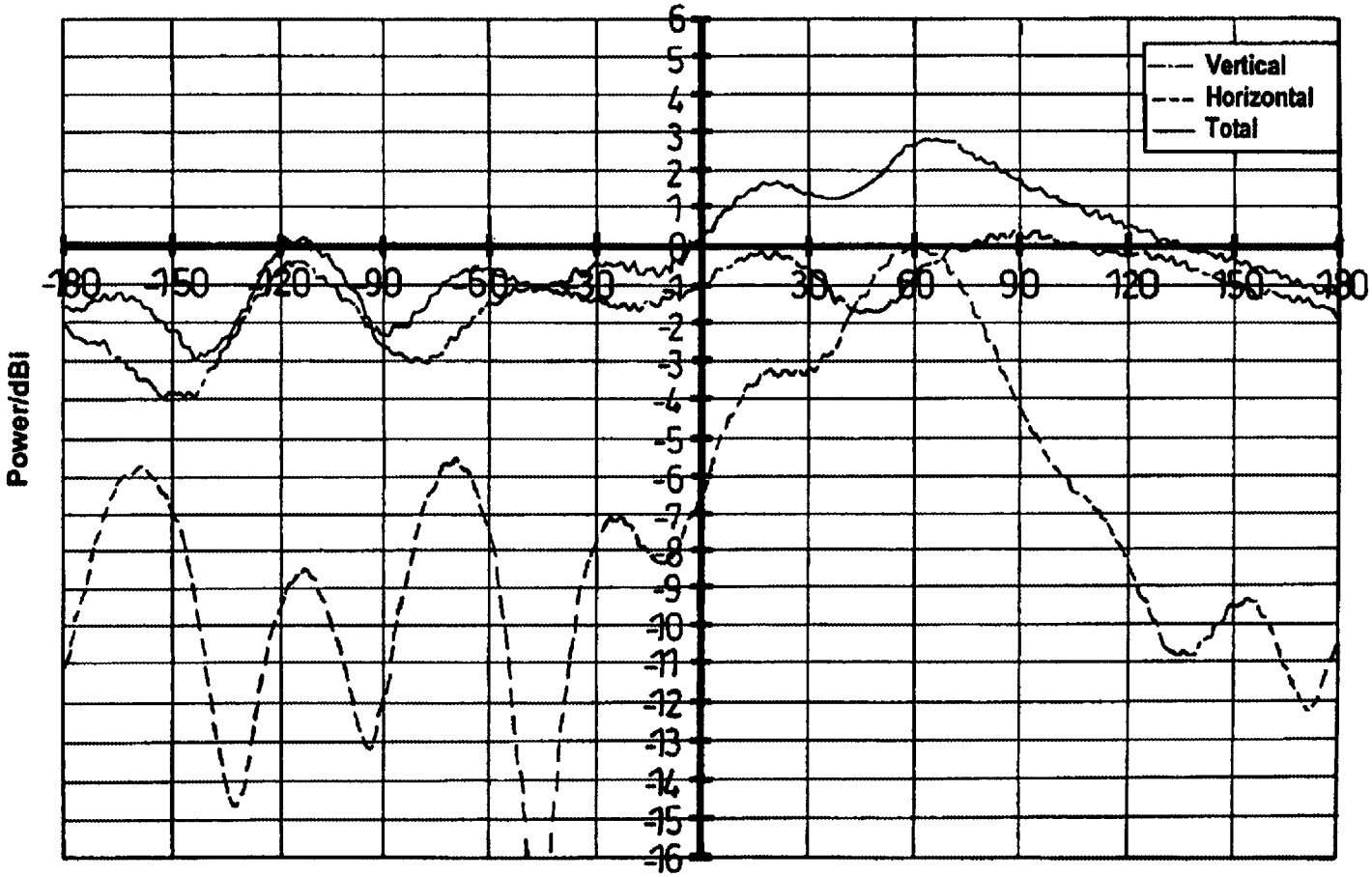
FIGS. 32–34 show modelled radiation patterns of the wall mounted configuration basestation at 850 MHz; and Table 1 shows a summary of azimuth, phase and gain for a 1900 MHz basestation.
Figure 33:
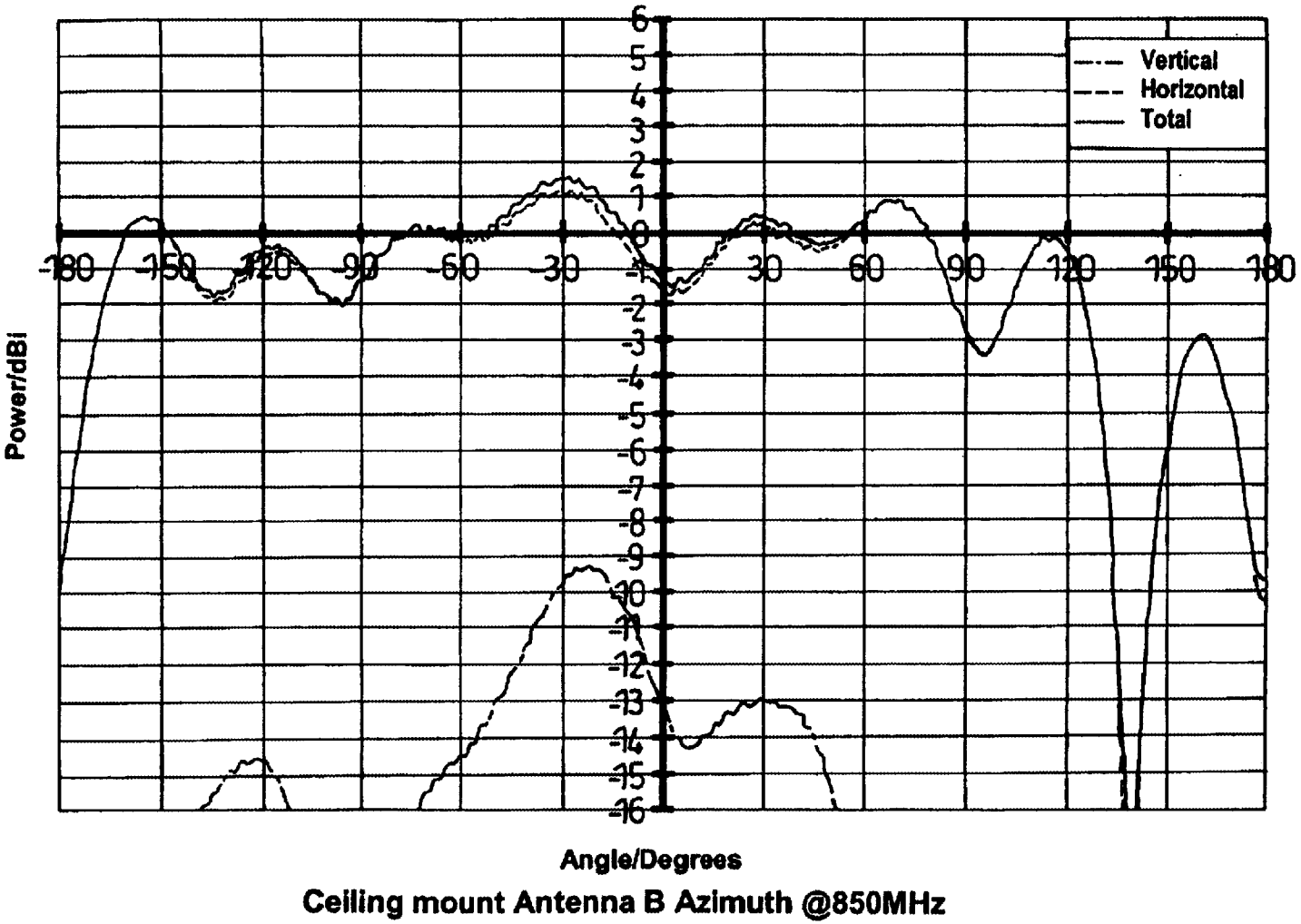
Figure 34:
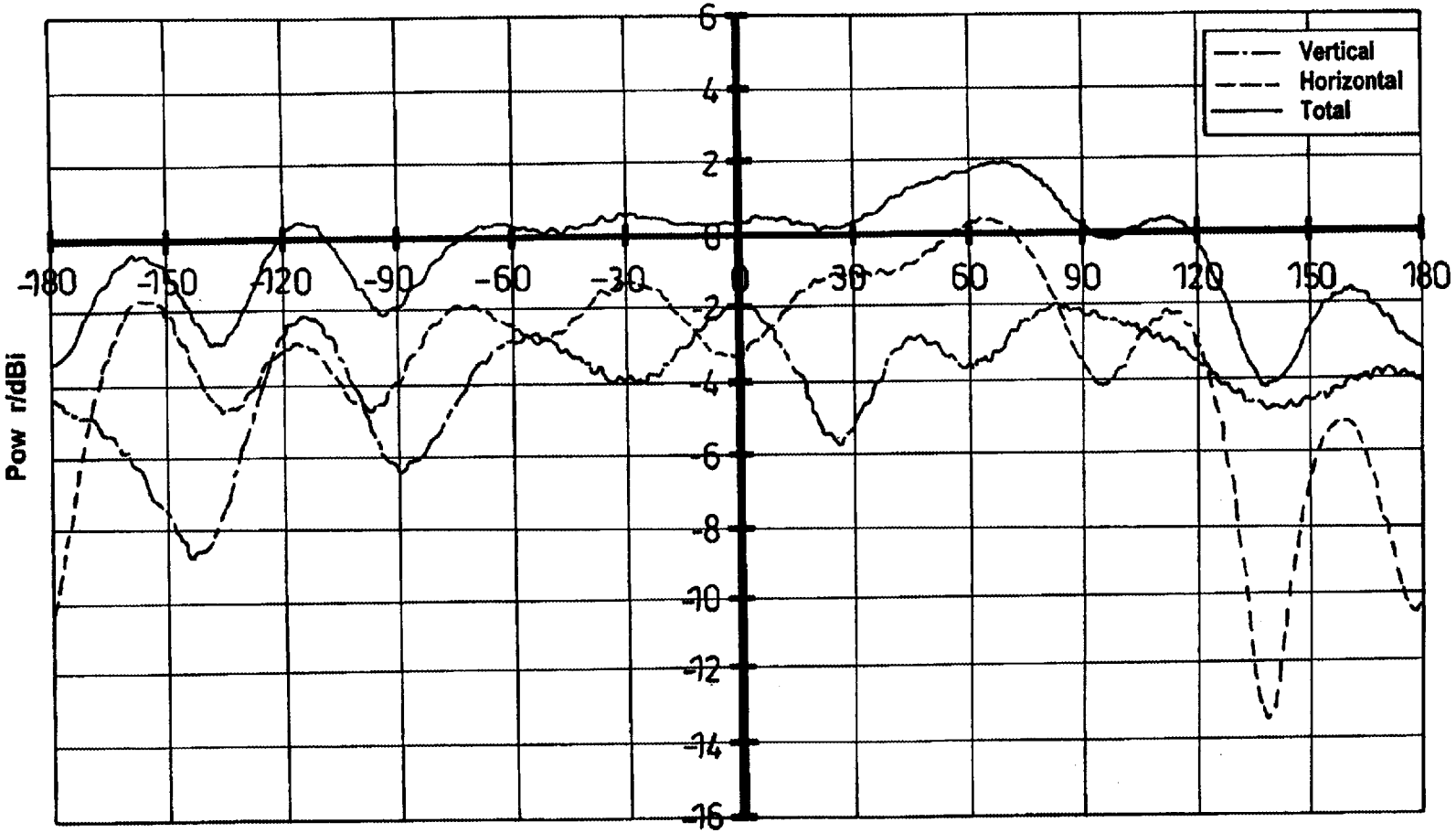

The measured radiation patterns have been mathematically combined to produce downlink radiation patterns. These patterns are shown in FIGS. 31 and 34. The Figures show that for the wall mount case a front to back ratio of 3–4 dB is present. There is also a problem at the lowest measured frequency due to the mismatched antenna element. The ceiling pattern shows very good performance due to the very orthogonal patterns.

It is possible to transmit on an additional remote antenna to provide coverage in certain areas e.g. in areas blocked from reception by lift shafts by disconnecting the cable run to each internal antenna and replacing it with one to a remote antenna. This approach requires a bulkhead on the basestation shielding can to enable the attachment of the antenna cables. Cables will be routed between the external plastics and the shielding can to connect the antennas. These cables would need to be routed for optimum performance (preferably between the heatsink fins).

What is claimed is:

1. An antenna arrangement comprising:

a mounting surface;

a first ground plane parallel to said mounting surface bearing a first antenna having a polarisation perpendicular to said first ground plane; and a second ground plane arranged substantially perpendicular to said mounting surface and bearing a second antenna having a polarisation perpendicular to said second ground plane;

wherein the first and second antennas are not co-planar with respect to one another; and in use each antenna produces a substantially omnidirectional antenna pattern in an azimuth plane; and wherein said antenna arrangement is capable of being mounted in two orthogonal orientations wherein:

in a first orientation said mounting surface is horizontal, said first antenna has a first polarization and said second antenna has a second polarization and in a second orientation said mounting surface is vertical, said first antenna has said second polarization and said second antenna has said first polarization.

2. An antenna arrangement as claimed in claim 1 wherein said antennas each comprise a second radiating section which is provided by a bent section extending substantially parallel to the adjacent ground plane.

3. An antenna arrangement as claimed in claim 1 wherein said antennas are planar inverted F antennas.

4. An antenna arrangement as claimed in claim 1 wherein said second ground plane and said first antenna are not co-planar.

5. An antenna arrangement as claimed in claim 1 wherein the ground planes form part of a box structure.

6. An antenna arrangement as claimed in claim 5 wherein the box structure encloses electrical control circuitry associated with the receiver and transmitters for the antennas and the outside surface has heat sink fins.

7. An antenna arrangement as claimed in claim 1 wherein the antennas are located adjacent a corner of their respective ground planes.

8. An antenna arrangement as claimed in claim 7 wherein the antennas are located within less than a wavelength of the frequency of operation of said corners.

9. A method of operating an antenna arrangement comprising:

a mounting surface;

a first ground plane parallel to said mounting surface bearing a first antenna having a polarisation perpendicular to said first ground plane; and a second ground plane arranged substantially perpendicular to said mounting surface and bearing a second antenna having a polarisation perpendicular to said second around plane;

wherein the first and second antennas are not co-planar with respect to one another and in use each antenna produces a substantially omnidirectional antenna pattern in an azimuth plane; and said antenna arrangement is capable of being mounted in two orthogonal orientations wherein:

in a first orientation said mounting surface is horizontal, said first antenna has a first polarization and said second antenna has a second polarization and in a second orientation said mounting surface is vertical, said first antenna has said second polarization and said second antenna has said first polarization, the method comprising:

operating said first antenna in a predetermined polarization.

10. A method as claimed in claim 9 wherein said predetermined polarization is vertical or horizontal polarization.

11. A method as claimed in claim 10 wherein said antennas are planar inverted F antennas.

12. A method as claimed in claim 9 wherein the antenna arrangement is operated by receiving or transmitting on both antennas to provide receive or transmit diversity.

13. A method as claimed in claim 9 which further comprises:

in a transmit mode, transmitting a signal from the antenna structure by combining the outputs of the first and second antennas; and in a receive mode, operating the first and second antennas as a diversity pair.

* * * * *